US006593052B2

(12) United States Patent
Yoshikawa et al.

(10) Patent No.: US 6,593,052 B2
(45) Date of Patent: Jul. 15, 2003

(54) TONER, IMAGE FORMING METHOD AND PROCESS CARTRIDGE

(75) Inventors: Junko Yoshikawa, Ibaraki (JP); Yuichi Mizoo, Ibaraki (JP); Satoshi Matsunaga, Shizuoka (JP); Tadashi Dojo, Shizuoka (JP); Nene Shibayama, Shizuoka (JP); Ryota Kashiwabara, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/915,331

(22) Filed: Jul. 27, 2001

(65) Prior Publication Data

US 2002/0045120 A1 Apr. 18, 2002

(30) Foreign Application Priority Data

| | | |
|---|---|---|
| Jul. 28, 2000 | (JP) | 2000-228192 |
| Jul. 28, 2000 | (JP) | 2000-228193 |
| Jul. 28, 2000 | (JP) | 2000-228196 |
| Jun. 26, 2001 | (JP) | 2001-192312 |

(51) Int. Cl.[7] ..... G03G 9/087
(52) U.S. Cl. ..... 430/108.5; 430/126; 399/111
(58) Field of Search ..... 430/108.5, 108.22, 430/120, 126; 399/111

(56) References Cited

U.S. PATENT DOCUMENTS

| | | | | |
|---|---|---|---|---|
| 4,883,735 A | | 11/1989 | Watanabe et al. | 430/109 |
| 5,798,199 A | * | 8/1998 | Bilbrey et al. | 430/110 |
| 5,976,752 A | | 11/1999 | Matsunaga et al. | 430/110 |
| 6,232,027 B1 | | 5/2001 | Matsunaga et al. | 430/109 |

FOREIGN PATENT DOCUMENTS

| | | |
|---|---|---|
| JP | 57-171345 | 10/1982 |
| JP | 62-195681 | 8/1987 |
| JP | 63-184762 | 7/1988 |
| JP | 2-623684 | 6/1997 |
| JP | 11-153885 | 6/1999 |
| JP | 2000-56511 | 2/2000 |
| JP | 2000-56578 | 2/2000 |

* cited by examiner

*Primary Examiner*—John Goodrow
(74) *Attorney, Agent, or Firm*—Fitzpatrick, Cella, Harper & Scinto

(57) ABSTRACT

A toner containing toner particles and an inorganic fine powder; the toner particles containing at least a binder resin, a colorant, a sulfur-containing resin, and a wax; the binder resin containing a hybrid resin component containing a vinyl type polymer unit and a polyester unit, and the sulfur-containing resin being a resin selected from the group consisting of sulfur-containing polymers and sulfur-containing copolymers

49 Claims, 4 Drawing Sheets

TONER, IMAGE FORMING METHOD AND PROCESS CARTRIDGE

BACKGROUND OF THE INVENTION

1. Field of the Invention

The present invention relates to a toner to be used for a recording method such as an electrophotographic method, an electrostatic recording method, an electrostatic printing method. A toner jet recording method, and the like and also relates to an image forming method using the toner and a process cartridge making use of the toner.

2. Related Background Art

The electrophotographic method involves generally using a photoconductive material and forming an electrostatically charged image on a photosensitive member by a variety of means, then developing the electrostatically charged image (electrostatic image) by a toner, transferring the toner image to a transfer material such as paper, if necessary, and fixing the toner image by a heating, pressurizing, heating and pressurizing, or solvent evaporating step to obtain a fixed image The developing applied to the electrophotographic method can be roughly classified into dry developing and wet developing. The former method can further be divided into a method using a two-component developer and a method using a one-component developer.

The toner to be employed for the dry developing is a particle obtained by dispersing a colorant in a binder resin and finely pulverizing the resulting mixture to about 5 to 15 μm. Used as a magnetic toner, which is a one-component developer, are those containing magnetic fine particles as the colorant. Further, in the case of the two-component developer, a toner containing a pigment such as carbon black as a colorant and a carrier particle of an iron powder or a magnetic ferrite particle are mixed to be used.

To provide a toner particle with electric charge, a dye, a pigment, or a polymer (high-molecular) compound is added as a charge control agent, and as positive triboelectric charge control agent, used are a nigrosine dye, an azine dye, a phthalocyanine-copper complex dye, a quaternary ammonium salt and the like and as a negative triboelectric charge control agent, used are an organometallic compound of a monoazo dye, organometallic compounds of salicylic acid, naphthoic acid, and dicarboxylic acid, a charge control resin, which is a polymer having a sulfonic acid group, and the like.

In Japanese Patent Application Laid-Open No. 57-171345, disclosed is a toner using a copolymer of a styrene type monomer, a (meth)acrylic monomer, and an unsaturated polyester resin as binder resin and containing a specified amount of the unsaturated polyester resin. However, it is desired to further improve the charging stability of the toner.

In Japanese Patent Application Laid-Open No. 62-195681, disclosed is a toner containing as a main component of binder resin a polyester resin containing a specified amount of vinyl resin having a specified molecular weight and a specific glass transition temperature. However, it is desired to further improve the charging stability of the toner In Japanese Patent Application Laid-Open No. 11-153885, disclosed are a toner binder of resin obtained by reaction of a polyester resin having a specified molecular weight and a vinyl type polymer having a specified structure and a toner using the binder. However, it is desired to further improve the charging stability of the toner.

In Japanese Patent Application Laid-Open No. 2000-56511, disclosed is a toner containing a binder resin which contains a hybrid resin component, a specified amount of a component insoluble in a specified solvent, and a tetrahydrofuran-soluble matter having a specified molecular weight distribution. However, it is desired to further improve the rising of the electric charging in the high temperature and high humidity environments.

In Japanese Patent Application Laid-Open No. 63-184762, disclosed is a toner containing a copolymer produced by copolymerzation of a specified acrylamidosulfonic acid monomer and styrene in order to provide the toner with a stable charging property. However, it does not contain any description referring to a combination of a hybrid resin component and the copolymer.

In Japanese Patent No. 2623684, disclosed is a toner containing a thermoplastic resin as the binder resin and a copolymer produced by copolymerization of a specified acrylamide-based monomer having a sulfonic acid group and a specified structure and a vinyl type monomer as the charge control resin in order to improve rising of the electric charge quantity of the toner. However, it does not contain any description referring to a combination of the charge control resin and a hybrid resin Component.

In Japanese Patent Application Laid-Open No. 2000-56518, disclosed is a toner containing a sulfonic acid group-containing (meth)acrylamide copolyer having a specified glass transition temperature as a charge control resin in order to provide a toner having excellent charging stability and little dependence on the ambient environments. However, it does not contain any description referring to a combination of the charge control resin and a hybrid resin component.

SUMMARY OF THE INVENTION

An object of the present invention is to provide a toner of which the above described problems are solved.

Another object of the present invention is to provide a toner, an image forming method, and a process cartridge with improved fogging preventive property, charging stability, environmental dependency of the electric charge, and rising characteristic of the charging.

A further object of the present invention is to provide a toner, an image forming method, and a process cartridge which scarcely cause fogging and are excellent in charging stability and further are improved both in fixing performance and high temperature anti-offset property.

Still another object of the present invention is to provide a toner containing a sulfur-containing polymer which is satisfactory in the dispersibility in binder resin and excellent in the initial step-charging-rising property independently of the ambient environments, and to provide an image forming method and a process cartridge making use of the toner.

To achieve the objects of the present invention, in accordance with an-aspect of the invention, there is provided a toner comprising toner particles and an inorganic fine powder, wherein the toner particles comprise at least a binder resin, a colorant, a sulfur-containing resin, and a wax; wherein the binder resin contains a hybrid resin component comprising a vinyl means for developing the electrostatically charged image formed on the image bearing member by use of a toner and both of which are supported as one unit, the process cartridge being detachably mountable to an image forming apparatus main body, wherein the toner comprises toner particles and an inorganic fine powder; the toner particles comprising at least a binder resin, a colorant, a sulfur-containing resin, and a wax; the binder resin containing a hybrid resin component comprising a vinyl type polymer unit and a polyester unit, and the sulfur-containing resin being a resin selected from the group of sulfur-containing polymers and sulfur-containing copolymers.

DETAILED DESCRIPTION OF THE PREFERRED EMBODIMENTS

Figure 1:
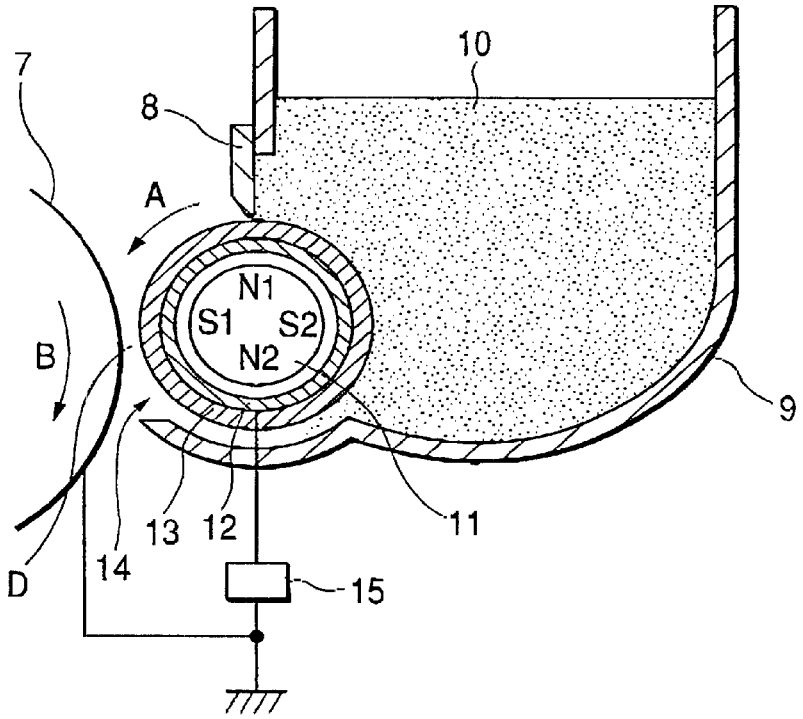
FIG. 1 is a schematic view showing an example (a magnetic blade is used as a restricting member) of a developer supplementing type development apparatus which is used for an image forming apparatus in which a toner of the present invention is used and into which a developer carrying member is incorporated

According to investigation of the inventors of the present invention, it has been found effective to use a hybrid resin containing a polyester unit and a vinyl type polymer unit as a binder resin for a toner and to add a sulfur-containing resin in order to obtain a toner having good fixing performance as well as a good charging property for a long duration without being affected with the ambient conditions.

According to investigation of the inventors of the present invention, it has been found important to combine a binder resin and a sulfur-containing resin in order to provide a toner with a good changing property. That is because if the sulfur-containing resin exists in compatible state with the binder resin in toner particles, the rising of charging of the toner cannot be improved and if it exists in completely separate phase from the binder resin, the stability of the charging property of the toner in environments cannot be improved.

In a toner of the present invention, the glass transition temperature (Tg) of the sulfur-containing resin may be sufficient to be 30 to 120° C., preferably 50 to 100° C., and more preferably 72 to 95° C. In either case where the glass transition temperature (Tg) of the sulfur-containing resin is lower than 30° C. or higher than 120° C., the dispersion state of the sulfur-containing resin is hardly controlled to be in suitable condition for the toner of the present invention and sufficient charging property is difficult to be obtained.

In the toner of the present invention, the weight average molecular weight (Mw) of the sulfur-containing resin may be sufficiently 2.000 to 200,000, preferably 17,000 to 100,000 and more preferably 27,000 to 50,000. If the weight average molecular weight (Mw) is lower than 2,000, since the sulfur-containing resin is either in compatible state with or finely dispersed in the binder resin, the charging property is hardly improved and the fluidity and transfer property of the toner are deteriorated and therefore it is undesirable. On the other hand, if the weight average molecular weight (Mw) is more than 200,000, the sulfur-containing resin is phase-separated from the binder resin and sometimes completely isolated from the toner particles to result in increase of fog density or deterioration of environment-dependent stability of the charging property in some cases and therefore it is undesirable.

In the toner of the present invention, the acid value of the toner may preferably be 1 to 40 mg KOH/g, more preferably 5 to 30 mg KOH/g, and still more preferably 10 to 20 mg KOH/g, in either case where the acid value of the toner is less than 1 mg KOH/g or higher than 40 mg KOH/g, the dispersion of the sulfur-containing resin is not necessarily in good state and sometimes the image density is decreased in the copying operation and therefore it is undesirable.

In the toner of the present invention, the acid value of the binder resin may preferably be 1 to 50 mg KOH/g, more preferably 5 to 40 mg KOH/g, and still more preferably 10 to 30 mg KOH/g. In either case where the acid value of the binder resin is less than 1 mg KOH/g or higher than 50 mg KOH/g. It becomes difficult to adjust the acid value of the toner within a suitable range for the toner of the present invention.

In the toner of the present invention, the binder resin to be contained in toner particles is preferable to contain 1 to 50% by weight of THF-insoluble matter, more preferable to contain 5 to 40% by weight, still more preferable to contain 10 to 30% by weight. If the THF-insoluble matter contained in the binder resin in the toner is less than 1% by weight or more than 50% by weight, the sulfur-containing resin contained in the toner is difficult to be kept in the optimum state and the toner adhesion to a fixing member in the copying operation becomes conspicuous and therefore it is undesirable.

In the toner of the present invention, the THF-insoluble matter may preferably have a main peak in a region from 2,000 to 15,000 in the molecular weight, a Z-average molecular weight (Mz) of $2.0\times10^8$ or lower and a ratio (Mz/Mw) of the Z-average molecular weight (Mz) to the weight average molecular weight (Mw) in a region from 20 to 120 in the chromatogram by GPC measurement, more preferably have a main peak in a region from 4,000 to 12,000 in the molecular weight, a Z-average molecular weight (Mz) of $1.5\times10^8$ or lower and a ratio (Mz/Mw) of the Z-average molecular weight (Mz) to the weight average molecular weight (Mw) in a region from 30 to 100, and further more preferably have a main peak in a region from 6,000 to 10,000 in the molecular weight, a Z-average molecular weight (Mz) of $1.0\times10^8$ or lower and a ratio (Mz/Mw) of the Z-average molecular weight (Mz) to the weight average molecular weight (Mw) in a region from 40 to 80. In any case where it has a main peak in the molecular weight smaller than 2,000 and a ratio (Mz/Mw) smaller than 20, or it has a main peak in the molecular weight higher than 15,000 and a ratio (Mz/Mw) higher than 120, or it has a Z-average molecular weight (Mz) higher than $2.0\times10^{8,}$ it becomes difficult for the sulfur-containing resin added to the toner to be kept in a suitable state and image density sometimes tends to decrease in the copying operation and therefore it is undesirable.

In the toner of the present invention, the sulfur-containing resin is added mainly as a charge control agent and further has an effect to control the dispersion state of the colorant (especially a magnetic material) contained in the toner and preferable are sulfonic acid group-containing polymers or copolymers and more preferable are sulfur-containing polymers or copolymers containing an acrylamide sulfonic acid type monomer unit and particularly preferable are sulfur-containing polymers or copolymers containing 2-acrylamido-2-methylpropanesulfonic acid monomer unit and they can more efficiently control the dispersion state of a colorant (especially a magnetic material).

In the toner of the present invention, the sulfur-containing resin is preferably added in 0.01 to 20 parts by weight based on 100 parts by weight of the binder resin and more preferably added in 0.5 to 5 parts by weight and still more preferably added in 0.7 to 2 parts by weight. If the content of the sulfur-containing resin is less than 0.01 parts by weight or If it is more than 20 parts by weight, the charge of the toner is difficult to be controlled.

The toner of the present invention contains the sulfur-containing resin preferably in 20 ppm to 5% by weight in terms of sulfur atom on the basis of the weight of the toner, more preferably in 50 ppm to 1% by weight, and still more preferably 100 ppm to 0.5% by weight. If the content of the sulfur atom is either less than 20 ppm or higher than 5% by weight, it becomes hard to control the electric charge of the toner.

In the toner of the present invention, the sulfur-containing resin may be added in a form of a polymer (high-molecular) compound mainly composed of an aromatic vinyl monomer and (meth)acrylic acid ester monomer, a polymer compound having Formula (1), and/or a reaction product of these polymer compounds and polyesters R—X Formula (1)

wherein R represents a polymer block containing an aromatic vinyl monomer unit and a (meth)acrylic acid ester monomer unit as main components and X represents a polymer block which contains a monomer unit having sulfonic acid group and may contain a monomer unit having a carboxylic acid group or phosphoric acid group as a constituent component.

The polymer block denoted by R in Formula (1) is a polymer compound containing an aromatic vinyl monomer and a (meth)acrylic acid ester monomer as main components. Preferable as the aromative vinyl monomer is styrene and preferable as the (meth)acrylic acid ester monomer are acrylic acid ester monomers such as methyl acrylate, ethyl acrylate, propyl acrylate, butyl acrylate, 2-ethylhexyl acrylate, octyl acrylate, lauryl acrylate, and stearyl acrylate and especially preferable is a copolymer obtained by polymerization of styrene and 2-ethylhexyl acrylate or a copolymer obtained by polymerization of styrene and n-butyl acrylate. In this case, the copolymer is composed of preferably 60 to 90% by weight, more preferably 65 to 85% by weight, and still more preferably 70 to 80% by weight of styrene monomer and preferably 5 to 25% by weight, more preferably 7 to 22% by weight, and still more preferably 10 to 20% by weight of 2-ethylhexyl acrylate monomer or n-butyl acrylate monomer. In either the case where the content of styrene monomer is less than 60% by weight and the content of the (meth)acrylic acid ester monomer is more than 25% by weight or the case where the content of styrene monomer is more than 90% by weight and the content of the (meth)acrylic acid ester monomer is less than 5% by weight, the sulfur-containing resin in the binder resin of the toner is hardly kept in good state.

Further, in Formula (1), the polymer block denoted as X is a polymer compound which contains a monomer having a sulfonic acid group and may contain a monomer having a carboxylic acid group or a phosphoric acid group. As the monomer having a sulfonic acid group, preferable to be used is an acrylamidosulfonic acid derivative monomer and especially preferable to be used is 2-acrylamido-2-methylpropanesulfonic acid monomer As the monomer having a carboxylic acid group, preferable are acrylic acid, methacrylic acid, maleic acid, fumalic acid, maleic acid monoester, vinylbenzoic acid or hydroxycarboxylic acid esters of (meth)acrylic acid and as the monomer having a sulfonic acid group, preferable are 2-acrylamido-2-methylpropanesulfonic acid, 2-methacrylamido-2-methylpropanesulfonic acid, styrenesulfonic acid, maleic acid amide derivatives having a sulfonic acid group, maleimide derivatives having a sulfonic acid group, and styrene derivatives having a sulfonic acid group.

Regarding Formula (1), if a monomer having a carboxylic acid group as a constituent component is contained, the content may be 2 to 201 by weight, preferably 10 to 17% by weight, and more preferably 7 to 15% by weight. If the content of the monomer having a carboxylic acid group is less than 2% by weight, it is difficult to provide the toner with a sufficient triboelectric charging property and if the content is more than 20% by weight, uniform dispersion in a binder resin becomes difficult and therefore both cases are not preferable. Further, the polymer block denoted by R may be copolymerized with Se by weight or less of a monomer having as a substituent group a carboxylic acid group, a sulfonic acid group, or a phosphoric acid group copolymerized with polymer block denoted by X.

In the toner of the present invention, the polymer compound of Formula (1) may form a reaction product with a polyester. The reaction product with a polyester is a polymer compound produced by addition polymerization of an unsaturated polyester and the foregoing aromatic vinyl monomer, (meth)acrylic acid ester monomer, or a monomer having as a substituent a carboxylic acid group, a sulfonic acid group, or a phosphoric acid group and/or a polymer compound produced by esterification of the hydroxyl group of a polyester and the carboxylic acid group, the sulfonic acid group, or the phosphoric acid group of a polymer compound constituting a charge control agent, or by esterification of the carboxylic acid group of a polyester and the hydroxyl group of the polymer compound if the polymer compound constituting a charge control agent is copolymerized with a monomer having a hydroxyl group, and the polymer compound constituting the charge control agent may contain 1 to 98% by weight of the reaction product with the polyester.

The polymer compound of Formula (1) in the toner of the present invention may be obtained by copolymerization of a monomer forming the polymer block denoted by R and a monomer forming the polymer block denotes by X in a ratio of preferably from (90:10) to (30:70) by weight, more preferably from (85:15) to (35:65) by weight, and still more preferably from (80:20) to (40:60) by weight. If the content of the monomer forming the polymer block denotes by R is more than 90% by weight, it becomes difficult to provide a toner with a sufficiently high triboelectric charging property and If the content is less than 30% by weight, the dispersion in the binder resin of the toner tends to become uneven and therefore both cases are undesirable.

In the toner of the present invention, although the sulfur-containing polymer and the sulfur-containing copolymer can be produced by a variety of polymerization methods, a preferably polymerization method is a method using no polymerization solvent or a bulk polymerization method or solution polymerization method using a small amount of a polymerization solvent. As the reaction solvent. Usable are solvents such as methanol, ethanol, propanol, 2-propanol, propanone, 2-butanone and dioxane. In the case where these solvents are used in mixture. It is preferable to mix methanol, 2-butanone, and 2-propanol in a range from (2:1:1) to (1:5:5) As a polymerization initiator, usable are tert-butylperoxy-2-ethylhexanoate, cumyl perpivalate, tert-butyl peroxylaurate, benzoyl peroxide, lauroyl peroxide, octanoyl peroxide, di-tert-butyl peroxide, tert-butylcumryl peroxide, dicumyl peroxide, 2,2'-azobisisobutyronitrile, 2,2'-azobis(2-methylbutyronitrile), 2,2'-azobis(2,4-dimethylvaleronitrile), 2,2'-azobis(4-mathoxy-2,4-dimethylvaleronitrile), 4,4'-azobis-4-cyanovaleric acid, 1,1'-azobis(cyclohexane-1-carbonitrile), 1,1'-di(tert-butylperoxy)-3-methylcyclohexane, 1,1-bis(tert-butylperoxy)-3,3,5-trimethylcyclohexane, 1,1'-di(tert-butylperoxy)-3, 3,5-trimethylcyclohexane, 1,1-bis(tert-butylperoxy)cyclohexane, 1,4-bis(tert-butylperoxycarbonyl) cyclohexane, 2,2-bis(tert-butylperoxy) octane, n-butyl-4,4-bis (tert-butylperoxy) valerate, 2,2-bis(tert-butylperoxy)butane, 1,3-bis (tert-butylperoxyisopropyl)benzene, 2,5-dimethyl-2,5-di (tert-butylperoxy)hexane, 2,5-dimethyl-2,5-di (tert-butylperoxy) hexane, 2,5-dimethyl-2,5-di (benzoylperoxy)hexane, di-tert-butyldiperoxy isophthalate, 2,2-bis(4,4-di-tert-butylperoxycyclohexyl) propane, di-tert-butylperoxy-α-methylsuccinate, di-tert-butylperoxydimethyl glutarate, di-tert-butylperoxy hexahydroterephthalate, di-tert-butylperoxy azelate, 2,5-dimethyl-2,5-di(tert-butylperoxy) hexane, diethylene glycol-bis(tert-butylperoxycarbonate), di-tert-butylperoxytrimethyl adipate, tris(tert-butylperoxy) triazine, and vinyl tris(tert-butylperoxy)silane. They may be used solely or in combination with one another. It is preferable to use either solely or in combination 2,2'-azobis(2-methylbutyronitrile), 4,4'-azobis-4-cyanovaleric acid, 1,1'-di(tert-butylperoxy)-3-methylcyclohexane, and 1,1-bis (tert-butylperoxy)-3,3,5-trimethylcyclohexane. These polymerization initiators are preferable owing to that they make it possible to adjust the molecular weight of the sulfur-containing polymer or copolymer to be within a suitable range for the toner of the present invention and to decrease the unreacted monomers to increase the polymer addition ratio.

The polymer compound defined by Formula (1) can be produced either by properly selecting the monomer types to be copolymerized, the composition ratio, or the polymerization solvent and producing a state in which a same type monomer is made to exist locally in a polymer chain by making use of the difference in the copolymerization reactivity among monomers by continuously supplying the monomers to the polymerization system or by using a polymerization initiator having in the molecule two or more peroxide groups or azo groups with different half-life temperature and changing the monomer composition for polymerization and the polymerization temperature. In the case of the former production method, the composition of the polymer blocks defined by R and X is continuously changed as the polymerization reaction is proceeding and it may affect the dispersibility of the polymer block in the binder resin of the toner and the development property of the toner, but there is no problem in the practical application, and on the other hand, in the case of the latter production method, the composition change of the polymer blocks defined by R and C is relatively slight and therefore it is preferable in this regard.

In the toner of the present invention, it is preferable to add an organoaluminum compound and/or an organoiron compound as a charge control agent.

The organoaluminum compound includes compounds obtained by reaction of aromatic dioles, aromatic hydroxycarboxylic acids, aromatic monocarboxylic acids, and aromatic polycarboxylic acids with an aluminum compound (e.g. organoaluminum complex compounds (complexes and complex salts) or organoaluminum salts) and preferable one is an organoaluminum compound composed of 2 mole of 3,5-di-tert-butylsalicylic acid and 1 mole of aluminum element. The organoaluminum compound may be added to the toner preferably in 0.02 to 2% by weight, more preferably 0.05 to 1.5% by weight, and still more preferably 0.1 to 1% by weight in terms of aluminum element. If the content of the organoaluminum compound added to the toner is less than 0.02% by weight in terms of aluminum element, the addition effect is scarce. Further, the high-temperature anti-offset property may be sometimes decreased. If the content is higher than 2% by weight, the toner may easily be charged up and further the low-temperature fixing performance of the toner may be sometimes decreased and therefore both cases are undesirable.

The organoiron compound is preferably a compound obtained by reaction of a monoazo compound with an iron compound. The organoiron compound may be added to the toner preferably in 0.02 to 2% by weight, more preferably 0.05 to 1.5% by weight, and still preferably 0.1 to 1% by weight in terms of iron element. If the content of the organoiron compound added to the toner is less than 0.02% by weight in terms of iron element, the image density stability of the toner in the high temperature and high humidity environments for the toner may tend to be easily decreased and if the content is higher than 2% by weight, the image density stability of the toner in the normal temperature low humidity environments may tend to be easily decreased and therefore both cases are undesirable.

In the toner of the present invention, the organoaluminum compound is preferable as a charge control agent since the organoaluminum compound and the carboxyl group of the binder resin mutually affect each other in the melting and kneading process for the preparation of toner to carry out a kind of complex forming reaction supposed to be an exchange reaction of the ligands and to form THF-insoluble matter in the binder resin of the toner and so far, it has been difficult to control the amount of the THF-insoluble matter to be produced. In the case where the sulfur-containing resin exists, although it is not yet verified, the cooperative-effect of the foregoing organoaluminum compound with the binder resin and the sulfur-containing resin not only makes it possible to control the amount of the THF-insoluble matter to be produced but also makes the dispersion state of the wax in desirable state.

The wax contained in the toner of the present invention may preferably have a main peak in the molecular weight ranging from 300 to 20,000, a ratio (Mw/Mn) from 1.0 to 20 and more preferably have a main peak in the molecular weight ranging from 500 to 10,000 and a ratio (Mw/Mn) from 1.1 to 18 and still more preferably have a main peak in the molecular weight ranging from 700 to 5,000 and a ratio (Mw/Mn) from 1.2 to 15. If the main peak of the molecular weight of the wax is less than 300, the dispersion particle diameter of the wax in the toner particles may tend to easily become small and if the main peak of the molecular weight of the wax is higher than 20,000 and the ratio (Mw/Mn) is higher than 20, the dispersion particle diameter may tend to easily become large and in both cases, it becomes difficult to control the dispersion state of the wax in a preferable state.

The toner of the present invention is preferable to have an endothermic main peak in a range of 70 to 150° C., more preferably 75 to 130° C., and still more preferably 80 to 110° C. and at the same time to have an endothermic sub-peak or an endothermic shoulder, in the DSC curve measured by a differential scanning calorimetry (DSC) for the toner. If the toner has an endothermic peak in a temperature range other than the above described temperature ranges, it may become difficult to satisfy the low temperature fixing performances the hot anti-offset property, and anti-blocking property in good balance.

In the toner of the present invention, two or more different types of waxes may be added. The wax composition of a mixture of two or more types of waxes preferably has the main peak in the molecular weight ranging from 300 to 7,000 and the ratio (Mw/Mn) from 1.2 to 15 and more preferably the main peak in the molecular weight ranging from 350 to 4,000 and the ratio (Mw/Mn) from 1.5 to 12 and still more preferably the main peak in molecular weight ranging from 400 to 4,000 and the ratio (Mw/Mn) from 2 to 10. If the main peak molecular weight of the wax composition is less than 300 and the ratio (Mw/Mn) is less than 1.2 or if the main peak molecular weight of the wax composition is more than 7.000 and the ratio (Mw/Mn) is more than 15, it becomes difficult to control the dispersion state of the wax composition in good state.

The waxes to be added to the toner of the present invention are preferably hydrocarbon-based waxes, polyethylene-based waxes, or polypropylene-based waxes.

Preferable as the waxes to be added to the toner of the present invention are waxes of such as synthesized hydrocarbons obtained from the residues of distillation of hydrocarbons obtained by Aurge method using carbon monoxide and hydrogen as raw materials or obtained by hydrogenation of the residues. Further, hydrocarbon waxes fractionated utilizing a press perspiration method, a solvent method, vacuum distillation and by fractional crystallization method are used more preferably.

The waxes to be added to the toner of the present invention have a structure defined by the following formula (2).

$$CH_3—(CH_2—CH_2)_x—CH_2—CH_2—A \qquad \text{Formula (2)}$$

wherein, A represents a hydroxyl group or carboxyl group and x is an integer from 20 to 60, and preferably A denotes a hydroxyl group and x is an integer from 30 to 50.

If the wax to be added to the toner of the present invention is an acid-modified polyethylene, the wax is preferable to have an acid value of 1 to 20 mg KOH/g and to be polyethylene modified with one or more monomers selected from maleic acid, half-ester of maleic acid, and maleic anhydride and further preferable to have an acid value of 1.5 to 15 mg KOH/g.

If the wax to be added to the toner of the present invention is an acid-modified polypropylene, the wax is preferable to have the acid value of 1 to 20 mg KOH/g and to be polypropylene modified with one or more monomers selected from maleic acid, half-ester of maleic acid, and maleic anhydride and further preferable to have an acid value of 1.5 to 15 mg KOH/g.

If two types of waxes are to be added to the toner of the present invention, preferably at least one of the waxes is selected from the above described waxes.

In the toner of the present invention, the wax may be added to and dispersed to the toner in a kneading process and it is preferable to add wax in the production process of the binder resin since the dispersion state of the wax can easily be controlled.

In the toner of the present invention, if two or more types of waxes are added, the waxes to be added in the binder resin production process are preferably hydrocarbon type waxes, polyethylene type polymers, polypropylene type polymers, acid-modified polypropylene polymers having an acid value of 1 to 20 mg KOH/g, or acid-modified polyethylene polymers having an acid value of 1 to 20 mg KOH/g.

Table 1 shows examples of preferable combination of waxes to be added as a mixture of two type waxes to the toner of the present invention and the main peak molecular weight and the ratio (Mw/Mn) of the weight average molecular weight (Mw) and the number average molecular weight (Mn) in the case where those waxes are mixed in equal weight.

Next, the hybrid resin component to be used as a binder resin in the toner of the present invention will be described below.

In the toner of the present invention, the hybrid resin contained in the toner particles contains a polyester unit and a vinyl type polymer unit. The existence of the hybrid resin component can be confirmed by $^{13}$C-NMR measurement. In the case of a magnetic toner containing a magnetic material which inhibits the resolution capability of the $^{13}$C-NMR spectrum, measurement is made possible by using a toner whose magnetic material is dissolved in an aqueous concentrated hydrochloric acid solution by adding the toner in the solution and stirring at a room temperature for 70 to 80 hours. In the case of a toner containing carbon black and an organic pigment, the toner can be used as a measurement sample as it is. Some examples of the measurement results in the case of using styrene and an acrylic acid ester for a vinyl type polymer are shown in Table 2.

In the toner of the present invention, an alcohol component of the polyester unit includes ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, a bisphenol derivative having the following formula (3), and diols having the following formula (4).

(3)

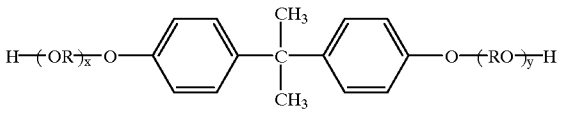

wherein the reference character R denotes ethylene or propylene; the reference characters x and y independently denote 1 or higher integer; and the average value of x+y is 2 to 10.

(4)

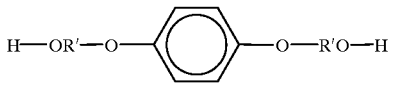

wherein the reference character R' denotes ethylene, propylene, or tert-butylene.

In the toner of the present invention, an acid component of the polyester unit includes an aromatic dicarboxylic acid such as phthalic acid, phthalic anhydride, isophthalic acid, and terephthalic acid; an alkyldicarboxylic acid or acid anhydride such as succinic acid, adipic acid, sebacic acid, and azelaic acid; succinic acid substituted with alkyl groups of 6 to 18 of carbons or its acid anhydride; an unsaturated dicarboxylic acid such as fumaric acid, maleic acid, and citraconic acid, or acid anhydride thereof.

In the toner of the present invention, as a vinyl monomer for forming a vinyl type polymer unit includes styrene; a styrene derivative such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; an ethylenic unsaturated monoolefin such as ethylene, propylene, butylene, and isobutylene; an unsaturated polyene such as butadiene; a vinyl halide such as vinyl chloride, vinylidene chloride, vinyl bromide, and vinyl fluoride; a vinyl ester such as vinyl acetate, vinyl propionate, and vinyl benzoate; an β-methylene aliphatic monocaboxylic acid ester such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; an acrylic acid ester such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; a vinyl ether such as vinyl methyl ether, vinyl ethyl ether, and vinyl isobutyl ether; a vinyl ketone such as vinyl methyl ketone, vinyl hexyl ketone, and methyl isopropenyl ketone; an N-vinyl compound such as N-vinylpyrrole, N-vinylcarbazole, N-vinylindole, and N-vinylpyrrolidone; vinyl naphthalene; acrylic acid or methacrylic acid derivative such as acrylonitrile, methacrylonitrile, and acrylamide: the foregoing α,β-unsaturated acid ester; and diester of a dibasic acid.

Further, the following vinyl monomers are also included; an unsaturated dibasic acid such as maleic acid, citraconic acid, itaconic acid, alkenylsuccinic acid, fumaric acid, and mesaconic acid; unsaturated dibasic acid anhydride such as maleic anhydride, citraconic anhydride, itaconic anhydride, and alkenylsuccinic anhydride; a half ester of an unsaturated dibasic acid such as methyl half ester of maleic acid, ethyl half ester of maleic acid, butyl half ester of maleic acid, methyl half ester of citraconic acid, ethyl half ester of citraconic acid, butyl half ester of citraconic acid, methyl half ester of itaconic acid, methyl half ester of alkenylsuccinic acid, methyl half ester of fumaric acid, and methyl half ester of mesaconic acid; an unsaturated dibasic acid ester such as dimethyl maleate and dimethyl fumarate; an α,β-unsaturated acid such as acrylic acid, methacrylic acid, crotonic acid, and cinnamic acid: an α,β-unsaturated acid anhydride such as crotonic acid anhydride and cinnamic acid anhydride; an anhydride of such an α,β-unsaturated acid and a lower aliphatic acid; a monomer containing carboxyl group such as alkenylmalonic acid, alkenylglutaric acid, alkenyladipic acid, their anhydrides, and their monoesters; acrylic acid or methacrylic acid esters such as 2-hydroxyethyl acrylate, 2-hydroxyethyl methacrylate, and 2-hydroxypropyl methacrylate; and a hydroxyl-containing vinyl monomer such as 4-(1-hydroxy-1-methylbutyl) styrene and 4-(1-hydroxy-1-methylhexyl) styrene. These monomers may be used either solely or as a mixture of two or more of them to compose a vinyl type polymer unit.

In the toner of the present invention, the polyester unit of the hybrid resin component is preferable to have a cross-linked structure with at lowest tri- or polybasic carboxylic acid or its anhydride or at lowest tri- or polyhydric alcohol. The at lowest tri- or polybasic carboxylic acid or its anhydride includes 1,2,4-benzenetricarboxylic acids 1,2,4-cyclohexanetricarboxylic acid, 1,2,4-naphthalenetricarboxylic acid, pyromellitic acid, or their anhydrides or their lower alkyl esters. The at lowest tri- or polyhydric alcohol includes 1,2,3-propanetriol, trimethylolpropane, hexanetriol, and pentaerythritol. Preferable ones are 1,2,4-benzenetricarboxylic acid and its anhydride.

In the toner of the present invention the vinyl type polymer unit of the hybrid resin component may have a cross-linked structure cross-linked using a cross-linking agent having two or more vinyl groups. The cross-linking agent to be used in such a case includes an aromatic divinyl compound such as divinylbenzene and a divinylnaphthalene; diacrylate compounds bonded through an alkyl chain such as ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and those compounds whose acrylates are substituted with methacrylates; diacrylate compounds bonded through an alkyl chain containing an ether bond such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and those compounds whose acrylates are substituted with methacrylates; diacrylate compounds bonded through a chain containing an aromatic group and an ether group such as polyoxyethylene (2)-2,2-bis(4-hydroxyphenyl) propane diacrylate, polyoxyethylene (4)-2, 2-bis (4-hydroxyphenyl)propane diacrylate, and those compounds whose acrylates are substituted with methacrylates: and polyester type diacrylate such as MANDA (trade name; produced by Nippon Kayaku Co., Ltd.).

As a polyfunctional cross-linking agent, usable are pentaerythritol triacrylate, trimethylolethane triacrylate, trimethylolpropane triacrylate, tetrarethylol methanetetraacrylate, oligoester acrylate, and those compounds whose acrylates are substituted with methacrylates: and triallyl cyanurate and triallyl trirmellitate.

These cross-linking agents are preferably added in 0.01 to 10 parts by weight (further preferably in 0.03 to 5 parts by weight) based on 100 parts by weight of other monomer components.

Among these cross-linking monomers, preferably usable ones in terms of fixing performance and anti-offset property of the toner are aromatic divinyl compounds (especially divinyl benzene) and diacrylate compounds bonded through a chain containing an aromatic group and an ether bond.

In the present invention, it is preferable to add a monomer component reactive with both resin units to the vinyl type copolymer unit and/or the polyester unit. Those reactive with the vinyl type polymer unit among monomers composing the polyester resin unit are unsaturated dicarboxylic acid such as fumaric acid, maleic acid, citraconic acid, and itaconic acid, and their anhydrides. Those reactive with the polyester unit among the monomer composing the vinyl type polymer unit are carboxyl- or hydroxyl-containing compounds and esters of acrylic acid or methacrylic acid.

As the method for obtaining reaction products of a vinyl type polymer unit and a polyester unit, a preferable method comprises a step of carrying out polymerization reaction in the presence of a polymer unit containing a monomer component reactive with either one or both polymer units of the foregoing vinyl type polymer unit and polyester unit.

The polymerization initiator to be used in the case of producing the vinyl type polymer unit of the present invention includes 2,2'-azobisisobutyronitrile, 2,2'-azobis(4-methoxy-2,4-dimethylvaleronitrile), 2,2'-azobis (-2,4-dimethylvaleronitrile). 2,2'-azobis(-2-methylbutyronitrile), dimethyl-2,2'-azobisisobutyrate, 1,1'-azobis(1-cyclohexanecarbonitrile), 2-(carbamoylazo)-isobutyronitrile, 2,2'-azobis(2,4,4-trimethylpentane), 2-phenylazo-2,4-dimethyl-4-methoxyvaleronitrile, 2,2'-azobis(2-methyl-propane): ketone peroxides such as methyl ethyl ketone peroxide, acetyl acetone peroxide, and cyclohexanone peroxide: 2,2-bis(tert-butylperoxy)butane, tert-butyl hydroperoxide, cumene hydroperoxide, 1,1,3,3-tetramethylbutyl hydroperoxide, di-tert-butylperoxide, tert-butyl cumyl peroxide, dicumyl peroxide, α,α'-bis (tert-butyl peroxyisopropyl)benzene, isobutyl peroxide, octanoyl peroxide, decanoyl peroxide, lauroyl peroxide, 3,5,5-trimethylhexanoyl peroxide, benzoyl peroxide, m-toluyl peroxide, di-isopropyl peroxydicarbonate, di-2-ethylhexyl peroxydicarbonate, di-n-propyl peroxydicarbonate, di-2-ethoxyethyl peroxycarbonate, di-methoxyisopropyl peroxydicarbonate, di(3-methyl-3-methoxybutyl) peroxycarbonate, acetylcyclohexylsulfonyl peroxide, tert-butyl peroxyacetate, tert-butyl peroxyisobutyrate, tert-butyl peroxyneodecanoate, tert-butyl peroxy-2-ethylhexanoate, tert-butyl peroxylaurate, tert-butyl peroxybenzoate, tert-butyl peroxyisopropylcarbonate, di-tert-butyl peroxyisophthalate, tert-butyl peroxyallylcarbonate, tert-amyl peroxy-2-ethylhexanoate-di-tert-butyl peroxyhexahydroterephthalate, and di-tert-butyl peroxyazelate.

Although it is sufficient for the binder resin of the toner of the present invention to contain the hybrid resin component containing the foregoing vinyl type polymer unit and polyester unit, it is preferable for the binder resin to be a resin composition containing a vinyl type polymer and polyester resin additionally to the hybrid resin component since it is made possible to keep the sulfur-containing resin contained in the toner of the present invention in good dispersion state and makes both the development property and the fixing performance of the toner satisfactory.

The binder resin of the toner of the present invention is preferable to contain 50 to 95% by weight of a polyester unit as the hybrid resin component or the hybrid resin component together with the polyester resin, further preferable to contain 60 to 90% by weight, and still more preferable to contain 65 to 85% by weight. If the content of the polyester unit is less than 50% by weight, the low temperature fixing performance and the high-temperature anti-offset property of the toner are sometimes deteriorated and therefore it is not preferable. If the content is more than 95% by weight, the high-temperature anti-offset property of the toner is sometimes deteriorated and therefore it is not preferable.

The following methods (1) to (6), for example, can be applicable as the method for producing such a resin composition containing the hybrid resin component, the vinyl type polymer, and the polyester resin.

(1) A method for blending the vinyl type resin, the polyester resin, and the hybrid resin component after their respective production. Blending involves removal of an organic solvent after dissolving and swelling the resin components in the organic solvent (for example, xylene) and the resin-composition is preferably produced by adding waxes in the blending step. Usable as the hybrid resin component is an ester compound synthesized by dissolving and swelling the vinyl type polymer and the polyester resin in a small amount of an organic solvent after their separate production, adding an esterification catalyst and an alcohol, and carrying out esterification exchange reaction by heating the resulting mixture.

(2) A method for producing the polyester unit and the hybrid resin component in the presence of the vinyl type polymer unit after the vinyl type polymer unit production. The hybrid resin component is produced by reaction of the vinyl type polymer unit (a vinyl type monomer may be added based on necessity) with the polyester monomers (an alcohol and a carboxylic acid) and/or polyester resin. In this case also, an organic solvent can be used if necessary. Preferably, waxes are added in this step.

(3) A method for producing the vinyl type polymer unit and the hybrid resin component in the presence of the polyester unit after the polyester unit production. The hybrid resin component is produced by reaction of the polyester unit (a polyester monomer may be added based on necessity) with the vinyl type monomer and/or the vinyl type polymer unit. Preferably, waxes are added in this step.

(4) A method for producing the hybrid resin component by producing a vinyl type polymer unit and polyester unit and then adding the vinyl type monomer and/or polyester monomers (an alcohol and a carboxylic acid) in the presence of these produced polymer units. In this case also, an organic solvent can be used if necessary. Preferably, waxes are added in this step.

(5) A method for producing the vinyl type polymer unit and the polyester unit by adding the vinyl type monomer and/or the polyester monomers (an alcohol and a carboxylic acid) after the hybrid resin component is produced and then carrying out addition polymerization and/or condensation polymerization reaction. In this case, those produced by the above described production methods (2) to (4) can be used as the hybrid resin component and also those produced by known methods can be used based on necessity. Further, an organic solvent may be used if necessary. Preferably, waxes are added in this step.

(6) A method for producing the vinyl type polymer unit, the polyester unit, and the hybrid resin component by mixing the vinyl type monomer and the polyester monomers (an alcohol, a carboxylic acid and the like) and successively carrying out addition polymerization and condensation polymerization reaction. Further, an organic solvent may be used if necessary. Preferably, waxes are added in this step.

In the above described production methods (1) to (5), polymer units having a plurality of different molecular weights and cross-linking degrees can be used as the vinyl type polymer unit and/or the polyester unit.

Among the above described production methods (1) to (6), especially the production method (3) is preferable since the molecular weight of the vinyl type polymer unit can easily be controlled and the production of the hybrid resin component can be controlled and further the dispersion state of waxes in the case of wax addition can be controlled.

The toner of the present invention is preferable to have the weight average particle diameter of 4 to 12 μm and to contain particles with 10.1 μm or larger particle diameter in less than 30% by volume, further preferable to have the weight average particle diameter of 5 to 9 μm and to contain particles with 10.1 μm or larger particle diameter in less than 20% by volume, and still more preferable to have the weight average particle diameter of 5.5 to 8 μm and to contain particles with 10.1 μm or larger particle diameter in less than 10% by volume. If the toner has the weight average particle diameter of larger than 12 μm and to contain particles with 10.1 μm or larger particle diameter in 30% by volume or more, the charging property of the toner sometimes becomes uneven and therefore it is not preferable.

In the case where the toner is a magnetic toner, the magnetic material to be used for the magnetic toner are preferably magnetic oxides such as magnetite, miaghemite, ferrite containing different types of elements and their mixtures.

Examples are magnetic Iron oxides containing at least one element selected from lithium, beryllium, boron, magnesium, aluminum, silicon, phosphorus, sulfur, germanium, titanium, zirconium, tin, lead, zinc, calcium, barium, vanadium, chromium, manganese, cobalt, copper, nickel, gallium, indium, silver, palladium, gold, platinum, tungsten, molybdenum, niobium, osmium, strontium, yttrium, technetium, ruthenium, rhodium, and bismuth. Among them, preferable elements are lithium, beryllium, boron. magnesium, aluminum, silicon, phosphorus, germanium, titanium, zirconium, tin, sulfur, calcium, barium, vanadium, chromium, manganese, cobalt, copper, nickel, strontium, bismuth, and zinc. Especially preferable magnetic iron oxides are those containing different types of elements selected from magnesium, aluminum, silicon, phosphorus, and zirconium. These elements may be included in the iron oxide crystal lattice or included in form of oxides in the iron oxide or may exist in form of oxides or hydroxides on the surface and it is preferable to be contained as oxides.

These elements can be taken in the particles by adding salts of these elements and adjusting the pH at the time of producing the magnetic material. Alternatively, these elements can be deposited on the surface of the particles by adjusting pH after the magnetic material particle production or adjusting pH after adding salts of respective elements.

The magnetic material containing these elements not only has high affinity for the hybrid resin to be effective to the hybrid resin having a specified acid value but also affect the sulfur-containing resin to be used for the toner of the present invention as to keep the resin in excellent dispersion state. Further, since the particle size distribution of these magnetic materials can be narrowed and the dispersibility of the materials in the hybrid resin is excellent, these magnetic materials are provided with an effect to make the electric charge of the toner even and to improve the charge stability.

The content of these different elements is preferably 0.05 to 10% by weight, further preferably 0.1 to 7% by weight, still more preferably 0.2 to 5% by weight, and especially preferably 0.3 to 4% by weight on the basis of iron element of the magnetic iron oxides. If the content is less than 0.05% by weight, the above described addition effects of these elements are slight and excellent dispersibility and electric charge evenness become hard to be obtained. On the other hand, if the content is more than 10% by weight, electric charge release tends to easily take place to cause insufficient electric charge and result in the deterioration of the image density and the increase of fogging and therefore both cases are undesirable.

Further, in the content distribution of these different elements, they are preferable to exist more in the periphery of the surface of the particles of the magnetic material. For example, if the solubility of iron element contained in the iron oxides is 20% by weight, it is preferable for the different elements to have 20 to 100% by weight of solubility in the total amount of the different elements existing, more preferable to have 25 to 100% by weight, and still more preferable to have 30 to 100% by weight. The dispersing effect and the electric diffusion effect can further be improved by increasing the amount of the different elements existing in the surface.

The number average particle diameter of the magnetic material is preferably 0.05 to 1.0 $\mu$m and further preferably 0.1 to 0.5 $\mu$m. The BET specific surface area of the magnetic material is 2 to 40 $m^2/g$ and further preferably 4 to 20 $m^2/g$. Regarding the 9-magnetic property of the magnetic material, the saturation magnetization measured in magnetic field of 795.8 kA/m is preferably 10 to 200 $Am^2/kg$ and further preferably 70 to 100 $Am^2/kg$. The residual magnetization is preferably 1 to 100 $Am^2/kg$ and further preferably 2 to 20 $Am^2/kg$. The coercive force is preferably 1 to 30 kA/m and further preferably 2 to 15 kA/m. The magnetic v material is to be added in 20 to 200 parts by weight based on 100 parts by weight of the binder resin.

An optional and proper pigment or dye can be used as a colorant for the toner of the present invention. The pigment includes carbon black, aniline black, acetylene black, naphthol yellow, Hansa Yellow, Rhodamine Yellow, Alizarine Yellow, red iron oxide, and Phthlocyanine Blue. The pigment is added preferably in 0.1 to 20 parts by weight, more preferably in 0.2 to 10 parts by weight based on 100 parts by weight of the binder resin. The dye includes azo type dyes, anthraquinone type dyes, xanthene type dyes, and methine type dyes. The dye is added preferably in 0.1 to 20 parts by weight, more preferably 0.3 to 10 parts by weight, based on 100 parts by weight of the binder resin.

In the toner of the present invention, toner particles are mixed with external additives of inorganic oxide fine powders such as silica, alumina and titania and of inorganic fine particles with ultrafine particle diameter such as carbon black and carbon fluoride.

The silica fine powder, the alumina fine powder, or the titania fine powder is preferable to become a fine particle when being dispersed on the surface of the toner particles since that provides the toner with high fluidity. The inorganic fine powder is preferable to have the number average particle diameter 5 to 100 nm and more preferable to have 5 to 50 nm.

It the addition amount of these inorganic fine particle is 0.03 to 5 parts by weight based on 100 parts by weight of the toner particles, the surface coating ratio of the toner particles becomes proper.

The toner of the present invention may contain other external additives of fluoro type resin powders such as a vinylidene fluoride fine powder and a polytetrafluoroethylene fine powder.

A preferable inorganic ultrafine powder is dried type silica or fumed silica produced by vapor-phase oxidization of a silicon halide compound. For example, thermal decomposition oxidation reaction of tetrachlorosilane gas in oxyhydrogen flames is utilized and the basic reaction formula is as follows.

$$SiCl_4+2H_2+O_2 \rightarrow SiO_2+4HCl$$

In this production process, another metal halide compound such as aluminum chloride or titanium chloride may be used together with a silicon halide compound to obtain a composite fine powder of silica and the other metal oxide. Regarding the particle diameter, the average primary particle diameter is preferably within a range from 0.001 to 2 $\mu$m and more preferably 0.002 to 0.2 $\mu$m and a silica fine powder having the number average particle diameter of 5 to 100 nm is preferable to be used.

As a commercialized silica fine powder produced by vapor-phase oxidation of a silicon halide compound, available are the products named as the following trade names.

AEROSIL (Nippon Aerosil Co., Ltd.) 130, 200, 300, 380, TT600, MOX 170, MOX 80, COK 84; Ca-O-Si-L (CABOT Co.) M-5, MS-7, MS-75. HS-5, RH-5: (WACKER-CHEMIE GMBH Co.) HDK, N20, 15, N20E, T30, T40; D-C Pine Silica (Dow Corning Corp.); Fransol (Fransil Co.)

The method for providing hydrophobicity can be carried out by chemically treating an organosilicon compound to be reacted with or physically adsorbing a silica fine powder. A preferable method comprises a step of treating a silica fine powder produced by vapor-phase oxidation of a silicon halide with an organosillcon compound.

Usable as the organosilicon compound are hexamethyldisilazane, trimethylsilane, trimethylchlorosilane, trimethylethoxysilane, dimethyldichlorosilane, methyltrichlorosilane, allyldimethylchlorosiltne, allylphenyldichlorosilane, benzyldimethylchlorosilane, bromomethyldimethylchlorosilane, α-chloroethyltrichlorosilane, chloroethyltrichlorosilane, β-chloromethyldirethylchlorosilane, triorganosilylmercaptan, trimethylsilylmercaptan, triorganosllyl acrylate, vinyldimethylacetoxysilane, dimethylethoxysilane, dimethyldimethoxysilane, diphenyldiethoxysilane, hexamethyldisiloxane, 1.3-divinyltetramethylaisiloxane, 1,3-diphenyltetramethyldisiloxane, and dimethylpolysiloxane having 2 to 12 siloxane units per 1 molecule and containing hydroxyl groups bonded to Si one by one in the terminal units. Further, silicone oils such as dimethylsilicone oil are included. These compounds are used solely or as a mixture of two or more of them.

The inorganic fine powder provides a good effect if It has preferably 30 $m^2/g$ or higher, more preferably 50 $m^2/g$ or higher, of the specific surface area measured by BET method based on nitrogen adsorption. The inorganic fine powder is preferable to be added in 0.01 to 8 parts by weight, more preferably 0.03 to 5 parts by weight, and still more preferably 0.1 to 4 parts by weight based on 100 parts by weight of the toner particles.

Regarding the hydrophobic degree of the inorganic fine powder to be used for the toner of the present invention, its wettability to methanol is preferably 30% or higher and more preferably 50% or higher. As the treatment agent to provide hydrophobicity, preferable ones are silane compounds and silicone oils, which are silicon-containing surface treatment agents.

For example, alkylalkoxysilane such as dimethyldimethoxysilane, trimethylethoxylsilane, butyltrimethoxylsilane; and silane coupling agents such as dimethyldichlorosilane, tri-methylchlorosilane, allyldimethylchlorosilane, hexamethylenedimethylchlorosilane, allylphenyldimethylchlorosilane, benzyldimethylchlorosilane, vinyltriethoxysilane, γ-methacryloxypropyltrimethoxysilane, divinylchlorosilane, dimethylvinylchlorosilane.

The toner of the present invention may be used as a two-component developer by being mixed with a carrier. The resistance value of the carrier is preferably adjusted to be $10^6$ to $10^{10}$ Ω·cm by controlling the unevenness of the carrier surface and the resin amount to be coated.

Usable as the resin for coating the surface of the carrier are a styrene-acrylic acid ester copolymer, a styrene-methacrylic acid ester copolymer, an acrylic acid ester copolymer, a methacrylic acid ester copolymer, silicone resin, fluoro resin, polyamide resin, ionomer resin, polyphenylenesulfite resin, and their mixtures.

Usable as the magnetic material for a carrier core are oxides such as a ferrite, an iron excessive type ferrite, a magnetite, γ-iron oxide and the like, metals such as iron, cobalt, and nickel, and their alloys. Elements allowed to be added to these magnetic materials are iron, cobalt, nickel, aluminum, copper, lead, magnesium, tin, zinc, antimony, beryllium, bismuth, calcium, manganese, selenium, titanium, tungsten, and vanadium.

In the toner of the present invention, a variety of additives may be used for the purpose to provide a variety of properties and the following are examples of the additives.

(1) available as a polishing agent are a metal oxide (strontium titanate, cerium oxide, aluminum oxide, magnesium oxide, chromium oxide), a nitride (silicon nitride), a carbide (silicon carbide), a metal salt (calcium sulfate, barium sulfate, calcium carbonate):

(2) available as a lubricating agent are a fluoro resin powder (polyvinylidene fluorides polytetrafluoroethylene) and an aliphatic acid metal salt (zinc stearate, calcium stearate): and (3) available as a conductive particle are a metal oxide (tin oxide, zinc oxide) and carbon black.

These additives are added preferably in 0.05 to 10 parts by weight and more preferably in 0.1 to 5 parts by weight based on 100 parts by weight of toner particles. These additives may be added solely or as a mixture of a plurality of types of the agents.

In the case of the magnetic toner, to use two or more types of inorganic fine powders of inorganic oxides or metal oxides is preferable in terms of durable stability of the development and development stability after storage. In the case of non-magnetic one-component developer, to use a titanium oxide fine powder or an alumina fine powder is preferable in terms of fluidity improvement and image uniformity.

In order to produce a toner particle of the present invention, a preferable method comprises steps of sufficiently mixing the above described toner particle constituent materials by a mixing apparatus such as ball mill and a Henschel mixer, well kneading the mixture by a thermally kneading apparatus such as a heat roll kneader and an extruder, cooling and solidifying the mixture, then mechanically roughly pulverizing the solidified material, finely milling the pulverized material by jet current or in a mechanical manner, and classifying the obtained powder to obtain a toner particle. Other than the above described production method, the following methods are to be employed: a polymer toner production method in which a predetermined material is added to a monomer which will constitute a binder resin to form an emulsified suspension and then polymerize the materials to obtain a toner particle: a method for adding prescribed materials to a core material or a shell material, or both of them in the case of a microcapsule toner composed of the core material and the shell material; a method by dispersing the constituent materials to a binder resin solution and then spraying and drying the resultant mixture to obtain a toner particle. Further, the toner of the present invention can be obtained by sufficiently mixing the toner particles with desired additives by a mixing apparatus such as a Henschel mixer.

Next, description will be given regarding the image formation method in which the toner of the present invention is suitably used.

The development means applicable to the image formation method of the present invention will be described.

In FIG. 1, an image bearing member (for example, an electrophotographic photosensitive drum) 7 carrying an electrostatic image formed by a known process is rotated in the direction shown by the arrow B. A development sleeve 14 as a developer carrying member carries a toner 10 supplied from a hopper 9 and rotated in the direction shown by the arrow A to transport the toner 10 to the development area D at which the development sleeve 14 and the photosensitive drum 7 face to each other. In the case where the toner 10 is a magnetic toner, a magnet 11 is positioned in the development sleeve 14 in order to magnetically attract and hold the toner onto the development sleeve 14. The toner 10 receives frictional electrification capable of developing the electrostatic image on the photoconductive drum 7 by the friction with the development sleeve 14. The development sleeve 14 comprises a substrate 12 and a resin layer 13 formed on the substrate.

In order to restrict the layer thickness of the toner 10 transported to the development area D, in the case of a magnetic toner, a restriction magnetic blade 8 made of a ferromagnetic metal is hung down from a hopper 9 as to face to the development sleeve 14 at a gap of 200 to 300 $\mu$m to the surface of the development sleeve 14. The magnetic fluxes from the magnetic pole N1 of the magnet 11 are converged upon the blade 8, the thin film layer of the toner 10 is formed on the development sleeve 14. A non-magnetic blade may be used as the blade B. Further, in place of the magnetic blade, an elastic blade such as urethane rubber, silicone rubber or a chip plate can be used.

The thickness of the thin layer of the toner 10 formed on the development sleeve 14 is preferable to be further thinner than the minimum gap between the development sleeve 14 and the photosensitive drum 7 of the development area D. Such a toner thin layer is especially effective to a development apparatus for developing an electrostatic image (that is, a non-contact type development apparatus). However, the toner thin film is also applicable to a development apparatus in which the minimum gap between the development sleeve 14 and the photosensitive drum 7 is narrower than the thickness of the toner layer (that is a contact type development apparatus) in the development area.

The non-contact type development apparatus will be described below.

A development bias voltage is applied to the foregoing development sleeve 14 in order to fly the toner 10 carried on the development sleeve 14 from an electric power source 15. The development bias voltage to be applied to the development sleeve 14 is preferably the voltage given as the difference between the potential of the image part of the electrostatic image (the region where the toner 10 adheres to visualize an electrostatic image) and the potential in the background part when the d.c. voltage is employed. On the other hand, in order to improve the density of the development image or the gradation reproduction, an oscillating electric field whose direction is alternatingly inverted may be generated by applying the a.c. bias voltage to the development sleeve 14. In this case, it is preferable to apply the a.c. bias voltage obtained by overlaying the d.c. voltage components having the potential of the foregoing image part and the potential of the background part to the development sleeve 14.

In the case of regular development to visualize an image by allowing toner to adhere to high potential parts of an electrostatic image having high potential parts and low potential parts, the toner to be used is one to be charged with the polarity opposed to the polarity of the electrostatic image. On the other hand, in the case of reversal development in which an image is visualized by allowing toner to adhere to lower potential parts of an electrostatic image, a toner to be used is one to be charged with the same polarity as that of the electrostatic image. The high potential and the low potential are in terms of their absolute values. The toner 10 is charged with the polarity to develop the electrostatic image by friction with the development sleeve 14.

In the development apparatus, an elastic plate 17 made of a material having rubber elasticity such as urethane rubber and silicone rubber or a material having metal elasticity such as phosphor bronze and stainless steel is used as a member to restrict the layer thickness of the toner 10 of the development sleeve 14 and the elastic plate 17 is brought into contact with the development sleeve 14 by pressure. In such a development apparatus, a thiner toner layer can be formed on the development sleeve 8. Another constitution of the development apparatus shown in FIG. 2 is basically the same as the development apparatus shown in FIG. 1 and the same symbols as assigned in FIG. 1 denote the same members as those in FIG. 2.

Figure 2:
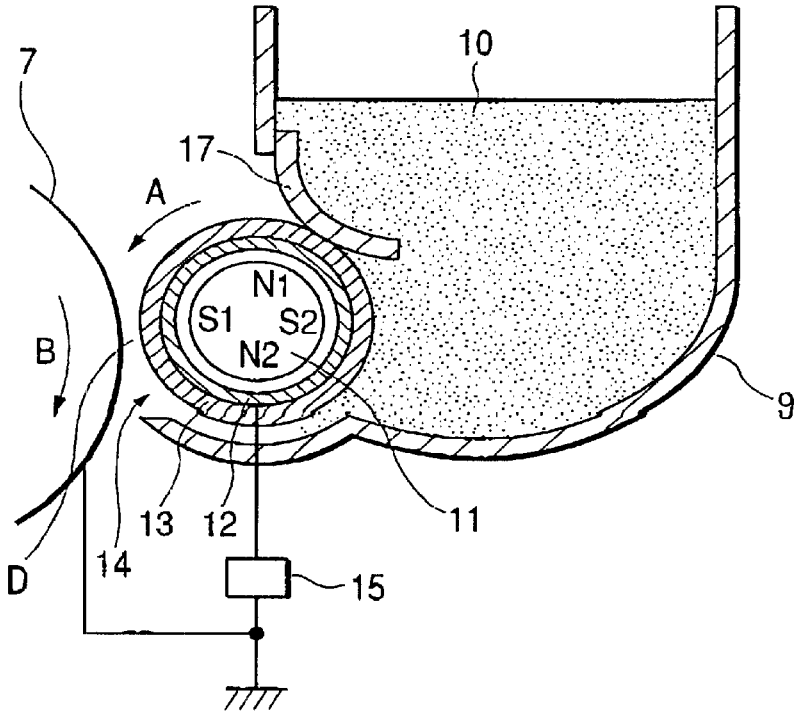
FIG. 2 is a schematic view showing an example (an elastic blade is used as a restricting member) of a developer supplementing type development apparatus which is used for an image forming apparatus in which a toner of the present invention is used and into which a developer carrying member is incorporated.

In the development apparatus illustrated in FIG. 2 for forming a toner layer on the development sleeve 14 as described above, since the toner is rubbed on the development sleeve 14 by the elastic plate 17, the frictional electrification quantity of the toner increases to improve the image density. Further, also in the case of the non-magnetic one-component type toner, such a development apparatus is applicable.

Figure 3:
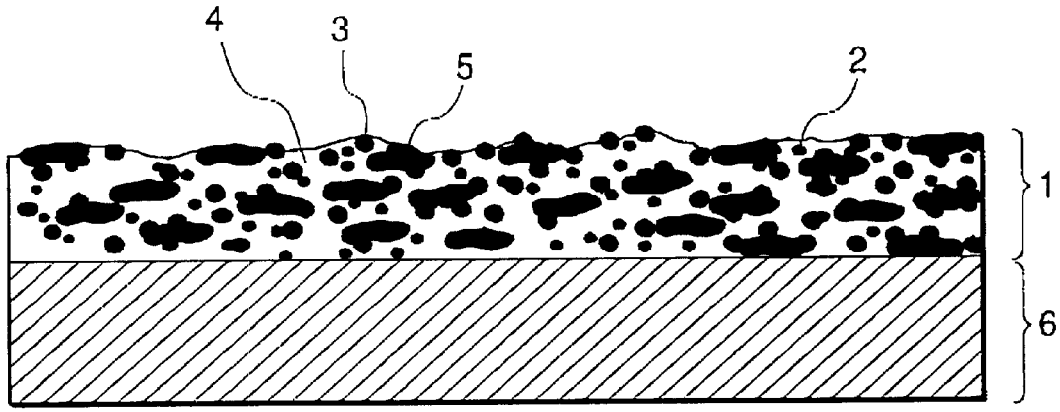
FIG. 3 is a schematic cross-sectional view of a part of a developer carrying member of a development apparatus to be employed for an image forming apparatus in which a toner of the present invention is used.

The development sleeve which is a developer carrying member to be employed for the present invention preferably comprises a cylindrical substrate and a coating layer (a resin layer) covering the substrate surface. The constitution is as shown in FIG. 3. The resin layer 1 contains the binder resin 4 and optionally a conductive material 2, a filler 3, and a solid lubricating agent 5 and is formed on the cylindrical substrate 6. In the case where the conductive material 2 is contained, since the resin layer 1 is conductive, the excess charge of the toner can be prevented. Further in the case where the filler 3 is contained, the wear of the resin layer 1 by the toner can be prevented and further the charge of the toner can properly be controlled owing to the charge-imparting properties of the filler 3. Also, in the case where the solid lubricating agent 5 is contained, the release properties can be improved between the toner and the development sleeve, and consequently, melt-adhesion of the toner onto the development sleeve can be prevented.

The development sleeve is provided with the resin layer having a volume resistance of preferably $10^6$ Ω·cm or lower and more preferably $10^3$ Ω·cm or lower. If the volume resistance of the resin layer is higher than $10^6$ Ω·cm, charge up of the toner easily takes place and blotches and deterioration in the development properties may occur.

Further, the surface roughness of the resin layer is preferably within a range from 0.2 to 3.5 $\mu$m on the basis of JIS center line average roughness (Ra). If Ra is smaller than 0.2 $\mu$m, the charge quantity of the toner in the vicinity of the sleeve is liable to increase, and owing to mirror image force, the toner is attracted to the sleeve so that new toner cannot receive electric charge from the sleeve, and therefore, the development performance tends to deteriorate. If the roughness Ra is higher than 3.5 $\mu$m, the toner coating amount on the sleeve is too much for the toner to sufficiently receive electric charge, so that the charge of the sleeve becomes uneven and image density decrease and density unevenness tend to occur.

The respective materials composing the resin layer 1 will be described with reference to FIG. 3.

As the conductive material 2, usable are metal powder such as aluminum, copper, nickel, and silver; metal oxide such as antimony oxide, indium oxide, and tin oxide; and carbon allotropy such as carbon fiber, carbon black, and graphite. Among them, carbon black is excellent in electric conductivity and is capable of providing the conductivity when filled in the polymer material and of providing an optional conductivity to a certain extent by controlling the amount to be added and therefore it is preferable to be used. The number average particle diameter of the carbon black is 0.001 to 1.0 μm and preferably 0.01 to 0.8 μm. If the number average particle diameter of the carbon black is wider than 1 μm, the volume resistance of the resin layer is hard to control and therefore it is not preferable.

The amount of the conductive material is preferably 0.1 to 300 parts by weight and more preferably 1 per 100 parts by weight, based on 100 parts by weight of the binder resin.

Usable as the filler 3 are known negative charge-providing charge control agents for toner or positive charge-providing charge control agents. Other fillers include inorganic compounds such as alumina, asbestos, glass fiber, calcium carbonate, magnesium carbonate, barium carbonate, barium sulfate, silica, and calcium silicate; phenol resin, epoxy resin, melamine resin, is silicone resin, PMMA, terpolymer of methacrylate (e.g polystyrene/n-butyl methacrylate/silane terpolymer), styrene-butadiene type copolymers, polycaprolactone: nitrogen-containing compounds such as polycaprolactam, polyvinylpyridine, and polyamide; highly halogenated polymers such as poly (vinylidene fluoride), poly(vinyl chloride), polytetrafluoroethylene, polytetrachlorofluoroethylene, pertluoroalkoxyethylene, polytetrafluoroalkoxyethylene, a fluorinated ethylene-propylene-polytetrafluoroethylene copolymer, and a trifluorochloroethylene-vinyl chloride copolymer; polycarbonates, and polyesters. Among them, silica and alumina are preferable to be used since they have their own hardness and charge controllability for the toner.

The amount of the filler is preferably 0.1 to 500 parts by weight and further preferable 1 to 200 parts by weight, based on 100 parts by weight of the binder resin.

As the solid lubricating agent 5, usable are molybdenum disulfide, boron nitride, graphite, fluorinated graphite, silver-niobium selenide, calcium chloride-graphite, and talc. Among them, graphite is preferable to be used since it has conductivity as well as lubricating properties and is capable of decreasing the toner particles having too much electric charge and providing the charge quantity suitable to development.

The amount of the solid lubricating agent is preferably 0.1 to 300 parts by weight and more preferably 1 to 150 parts by weight, based on 100 parts by weight of a binder resin.

In some cases, usable as the binder resin 4 in which the conductive material 2, the filler 3, and the solid lubricating agent 5 are dispersed are resins such as phenol resins, epoxy resins, polyamide resins, polyester resins, polycarbonate resins, polyolefin resins, silicone resins, fluoro-resins, styrene resins, and acrylic resins. Especially preferred is thermosetting or photocuable one.

In order to desirably expose the conductive substrate, the filler, and the solid lubricating agent contained in the resin layer on the surface of the development sleeve or in order to carry out surface smoothing treatment and form evenly roughened surface, the surface may be subjected to the smoothing treatment by means of such a polishing processing as described later, providing further preferable performance. In particular, the effects are significant in the prevention of vertical streaks occurring in solid black or half tone images and in the rise of the image density at the initial stage, especially, in a high temperature and high humidity environment. Since the surface of the sleeve can be so finished as to have even surface roughness by subjecting the sleeve to the polishing process with a belt-like polishing material bearing felt or abrasive grains, the amount of the toner coating the sleeve is made even, and consequently. Only the toner particles subjected to the frictional electrification with the sleeve are transported to the development region. As a result, the above described effects are supposed to be obtained Even after the smoothing treatment is carried out as described above, the coating layer surface is preferable to have surface roughness Ra within a range from 0.2 to 3.5 μm and more preferable within a range from 0.3 to 2.5 μm, based on the JIS B 0601. The reasons for that are as described above.

As the cylindrical substrate 6, preferably usable are a non-magnetic metal cylindrical tube, and a resin cylindrical tube. For example, usable as the non-magnetic cylindrical tube are a stainless steel cylindrical tube, an aluminum cylindrical tube, and a copper alloy cylindrical tube. The method for manufacturing the cylindrical tube includes a drawing method and an extrusion method and if the size precision is further increased in the cylindrical tube itself, a prescribed size precision is achieved by carrying out cutting and polishing. The straightness of the cylindrical tube is preferably 30 μm or less and further preferably 20 μm or narrower to give excellent images. If necessary, sand blast and polishing may be employed to roughen the surface in order to provide proper roughness. The abrasive grains to be used for blast may be shaped particles or shapelss particles.

Figure 4:
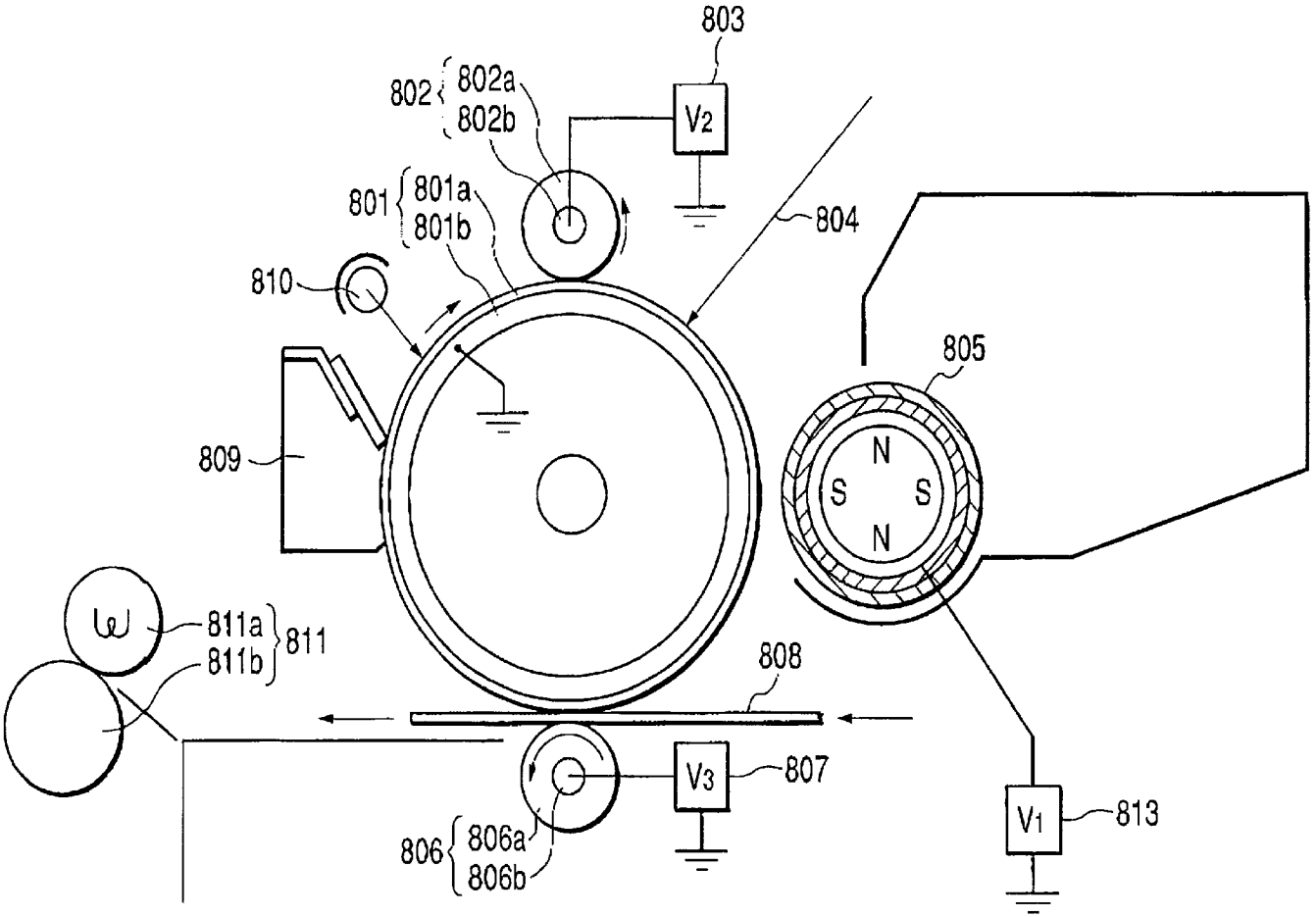
FIG. 4 is a schematic diagram of an image forming method in which a toner of the present invention is employed.

Next, one example of an image formation method of the present invention will be illustrated in FIG. 4. FIG. 4 shows an image forming apparatus comprising contact charging means and contact transferring means.

A rotation drum type photosensitive member 801 having a photosensitive layer 801*a* and a conductive base layer 801*b* is rotated at a prescribed peripheral speed (a process speed) in the clockwise rotation direction on the plane of the drawing. Bias voltage is applied to a charging roller 802 which is contact charging means having a conductive elastic layer 802*a* and a core (or mandrel) 802*b* by a charging bias power source 803. The charging roller 802 is brought into contact with the photosensitive member 801 by pushing force and subsequently rotated following the rotation of the photosensitive member 801.

The surface of the photosensitive member 801 is charged with a prescribed polarity at a prescribed potential by applying bias voltage $V_2$ to the charging roller 802. Then, an electrostatic image is formed by imagewise exposure 804 and successively visualized as a toner image by a development means 805.

Bias voltage $V_1$ is applied to the development sleeve composing the development means 805 by a development bias voltage application means 813. The toner image formed on a latent image bearing member by the development is electrostatically transferred to a transferring material 808 by a transferring roller 806 (a conductive elastic layer 806*a*, a core (mandrel) 806*b*) as a contact transferring means for bringing the transferring material 808 to which transferring bias voltage V. Is applied by the transferring bias power source 807 into contact with the photosensitive member 801 and the toner image on the transferring material is heat-pressure-fixed by a heating and pressurizing means 811 having a heating roller 811*a* and a pressurizing roller 811*b*. The photosensitive member 801 surface after toner image transfer is cleaned by removing the adhering pollutant materials using a cleaning apparatus 809 equipped with an elastic cleaning blade brought into contact with the photosensitive member 801 in the counter direction and further decharged by a decharging exposure apparatus 810, repeatedly carrying out image formation.

As a primary charging means, the description is given using the charging roller 802 as a contact charging means, however contact charging means such as a charging blade, a charging brush, and the like may be used and further non-contact corona charging means may be employed. The contact charging means is accompanied with less ozone generation in the charging process. As the transferring means, the description is given using the transferring roller 806, however transferring means such as a transferring blade, a transferring belt, and the like may be used and further non-contact corona transferring means may be employed. The contact transferring means is accompanied with less ozone generation in the charging process.

Figure 5:
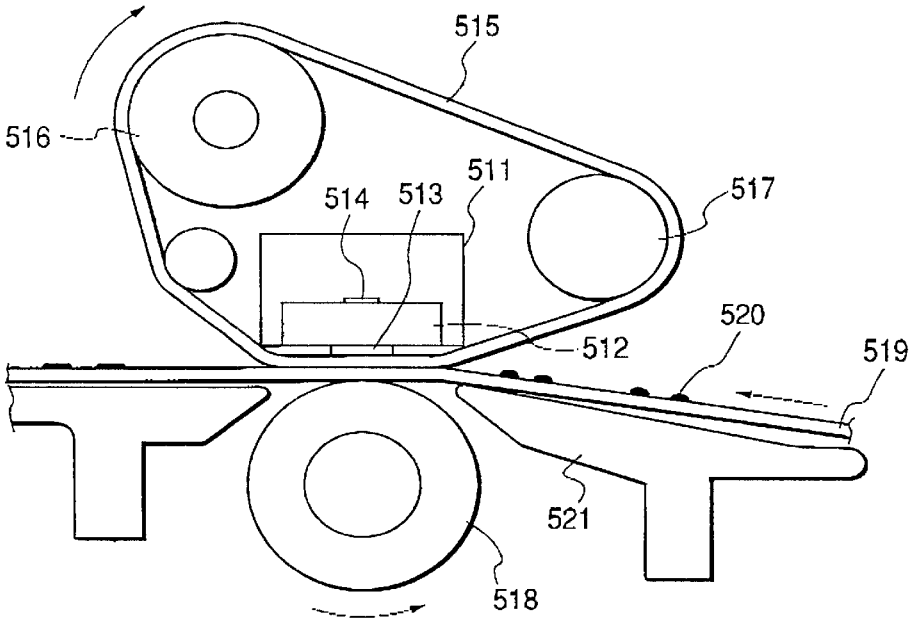
FIG. 5 is a schematic view of a fixing apparatus usable for an image forming method of the present invention.

Further, another fixing method applicable to an image formation method of the present invention will be described using a fixing means shown in FIG. 5. FIG. 5 shows a means for heating and fixing a recording material 519 bearing a toner image by a fixed and supported heating member 511 and a pressurizing member 518, opposite to the heating member, for pressing the recording material against the heating member through a film 515.

The heating member 511 in the fixing apparatus shown in FIG. 5 has a small heat capacity as compared with a conventional heating roll and has a linear heating part and the highest heating temperature of the heating part is preferably 100 to 300° C. The fixing film 515 positioned between the heating body 511 and the pressurizing roller 518 as a pressurizing member is preferably a heat resistant sheet with the thickness of 1 to 100 μm and usable as the heat resistant sheet are polymer sheets with high heat resistance such as polyesters, PET (polyethylene terephthalate), PFA (tetrafluoroethylene-perfluoro alkyl vinyl ether copolymer) PTFE (polytetra fluoroethylene), polyimides, polyamide, and also usable are metal sheets of aluminum and laminate sheets Composed of metal sheets and polymer sheets.

The constitution of a preferable fixing film comprises a heat resistant sheet having a release layer and/or a low resistance layer.

The reference numeral 511 denotes a low heat capacity linear heating member fixed and supported in the apparatus and its one example is an alumina substrate 512 with the thickness of 1.0 mm, the width of 10 mm, and the longitudinal length of 240 mm and coated with a resistant material 513 with the width of 1.0 mm and electrically communicated in both ends in the longitudinal direction. The electric communication is performed by changing pulses with a pulsed waveform of 20 msec cycle at DC 100V and a pulse width changed corresponding to the energy quantity to be released and at a desired temperature controlled by a temperature detection element 514 The approximate pulse width is 0.5 to 5 msec. In such a manner, the fixing film 515 is moved in the direction shown by an arrow while being brought into contact with the heating body 511 whose energy and the temperature are controlled.

An example of such a fixing film is an endless film composed of a heat resistant film with the thickness of 20 μm (for example, polyimide, polyether imide, PES, and PFA bearing fluoro resin such as PTFE, PAP at least in the image contacting face side) and a releasing layer containing a conductive agent and formed in the thickness of 10 μm on the heat resistant film. Generally, the total thickness is preferably thinner than 100 μm and more preferably thinner than 40 μm. The movement of the film is carried out by a driving roller 516 and a driven roller 517 in the direction shown by an arrow without forming wrinkles.

The reference numeral 518 denotes a pressurizing roller having a rubber elastic layer with good release properties such as silicone rubber. The pressurizing roller is employed to press the heating member at the total pressure of 39.2 to 196 N (4 to 20 kg) through a film and rotates while coming into pressure contact with the film. The un-fixed toner 520 on the recording material 519 is led to the fixing part by an inlet guide 521 to give a fixed image by the above described heating.

The fixing film 515, as described in the endless belt, may be a film having ends where using a sheet feeding axis and a reeling axis.

Figure 6:
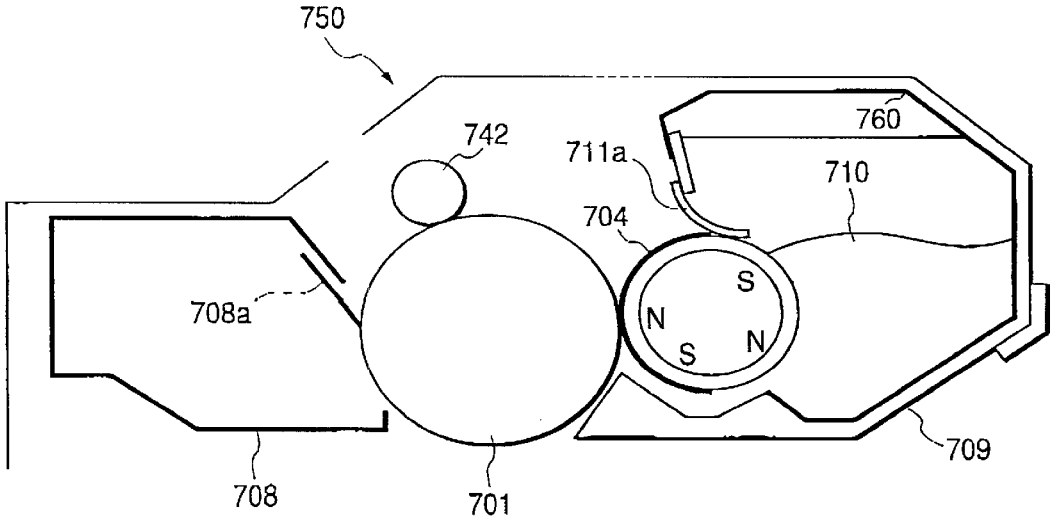
FIG. 6 is a schematic diagram showing an example of a process cartridge of the present invention.

FIG. 6 shows one practical example of a process cartridge of the present invention. The process cartridge is composed of at least a development means and an electrostatic image bearing member integrated into a cartridge, and so composed as to be freely detachable from an image forming apparatus main body (for example, a copying machine and a laser beam printer).

FIG. 6 shows a process cartridge 750 in which the following are assembled; developing means 709, a drum-like electrostatic image bearing member (a photoconductive drum) 701, a cleaner 708 having a cleaning blade 708*a*, and a primary charger (a charging roller) 742.

In FIG. 6, the developing means 709 comprises an elastic blade 711*a* and a toner container 760 containing a magnetic toner 710, using the magnetic toner 710, and a prescribed electric field is formed between the photosensitive drum 701 and the developing sleeve 704 by a bias voltage from a bias voltage application means at the time of development, and in order to properly carry out a development step, the distance between the photosensitive drum 701 and the developing sleeve 704 is very important.

The measurement methods of the physical properties relevant to the toner of the present invention will be described below.

(1) The Acid Value Measurement of Toner and Binder Resin

The measurement is carried out according to the measurement method described in JIS K0070.

The measurement apparatus: Automatic potentiometric titration apparatus AT-400 (manufactured by Kyoto Electronic Co.)

The calibration of the apparatus: using a mixed solvent of 120 ml of toluene and 30 ml of ethanol The measurement temperature: 25° C.

Preparation of a sample: A sample solution is prepared by adding 1.0 g of toner or 0.5 g of binder resin to 120 ml of toluene and stirring the mixture at a room temperature (about 25° C.) for 10 hours using a magnetic stirrer to dissolve the toner or the resin, and further adding 30 ml of ethanol.

(2) The Molecular Weight Measurement of THF-Soluble Matter

The molecular weight distribution of the binder resin or tetrahydrofuran (TRF)-soluble matter is measured by GPC (gel permeation chromatography) using THF as a solvent under the following conditions in this case, the molecular weight of 1000 or higher is measured.

Columns are stabilized in a heat chamber at 40° C. and as a solvent, THF is allowed to pass through the columns at the temperature at 1 ml/minute and about 100 μl of a THF sample solution is injected to carry out measurement At the time of the molecular weight measurement of the sample, the molecular weight distribution of the sample is computed on the basis of the relation between the logarithmic values of the calibration curve produced using several types of monodisperse polystyrene standardized samples and the counted values. Used as the standardized polystyrene samples for the calibration curve production are those with a molecular weight of about $10^2$ to $10^7$ produced by Tosoh Corporation or Showa Denko K.K. and at least ten of standardized polystyrene samples are proper to be employed As a detector, an RI (refractive index) detector is employed. As the columns, a plurality of commercialized polystyrene gel columns may be combined and examples of the combinations are as follows: Shodex GPC KF-801, 802, 803, 804, 805, 806, 807, and 800P produced by Showa Denko K.K., TSKgel G1000H ($H_{XL}$), G2000H ($H_{XL}$), G3000H ($H_{XL}$), G4000H ($H_{XL}$) G500H ($H_{XL}$), G6000H ($H_{Xl}$) G7000H ($H_{XL}$), and TSKgurd column produced by Tosoh Corporation.

Based on the molecular weight distribution measured by GPC as described above, the ratio of the molecular weight integration value of the molecular weights of 500,000 or higher to the molecular weight integration value of the molecular weights of 800 or higher is calculated to find the content of the components with molecular weight of 500,000 or higher.

A sample is produced as follows:

A sample is added to THF, left standing for several hours and then sufficiently shaken to be well mixed with THF (until agglomerates of the sample disappear) and then left standing for 12 hours or longer. At that time, the total time the sample is left standing in THF is controlled to be 24 hours or longer After that, the solution is allowed to pass through a sample treatment filter (the pore size of 0.2 to 0.5 μm; Maishoridisk H-25-2 (produced by Tosoh Corporation) may be used), obtaining a sample for GPC. The sample concentration is so adjusted as to bring the resin components into 0.5 to 5 mg/ml.

(3) Measurement of THF-Insoluble Matter

A toner sample to be subjected to the THF-insoluble matter measurement is weighed out in 0.5 to 1.0 g and placed in a cylindrical filter paper (No. 86R produced by Toyo Roshi Co., Ltd.: size: outer diameter 28 mm×height 100 mm) and put in a Soxhlet's extractor using 200 ml of THF, an extraction solvent. The temperature of the oil bath is controlled to be 120 to 130° C. for extraction and the time for reflux is controlled to be 120 to 150 seconds. The extraction time is set to be 10 hours. On completion of the extraction, the cylindrical filter paper is dried under reduced pressure for 10 hours at 70° C. and the THF-insoluble matter is calculated from the following equation:

$$\text{THF-insoluble matter (\% by weight)}=[W1-(W2+W3)]/(W1-W3)$$

wherein W1 denotes the weight of the toner sample; W2 denotes the THF-soluble matter of the binder resin; W3 denotes the component other than the binder resin contained in the toner (e.g. a magnetic material, waxes, external additives and the like).

(4) Measurement of the DSC Curve of Toner and the Endothermic Peak Temperature of Wax Measurement is carried out according to ASTM D 3418-82 using DSC-7 (Perkin-Ermer Co.), which is a differential scanning calorimeter (DSC measurement apparatus).

At first, 2 to 10 mg, preferably 5 mg, of a measurement sample is precisely measured.

The sample is put in an aluminum pan, and using an empty aluminum pan as a reference, measurement is carried out at a temperature increase rate of 10° C./min in a measurement temperature range of 30 to 200° C.

During the temperature increasing process, a DSC curve of the toner in the temperature range from 30 to 200° C. and the main peak of an endothermic peak of a wax in the DSC curve can be obtained. The temperature of the endothermic main peak is defined as the melting point of the wax.

(5) Measurement of Glass Transition Temperature (Tg) of Toner and Binder Resin

Measurement is carried out according to ASTM D 3418-82 using DSC-7 (Perkin-Ermer Co.), which is a differential scanning calorimeter (DSC measurement apparatus).

At first, 5 to 20 mg, preferably 10 mg, of a measurement sample is precisely weighed out The sample is put in an aluminum pan and using an empty aluminum pan as a reference, measurement is carried out at a temperature increase rate of 10° C./min in a measurement temperature range of 30 to 200° C. During the temperature increasing process, the main peak of an endothermic peak of a wax in a temperature range of 40 to 100° C. can be obtained.

The point of intersection of the middle line between the base lines at the beginning and at the end of the endothermic peak and the differential calorimetric curve is defined as the glass transition temperature Tg in the present invention.

(6) Measurement of Molecular Weight Distribution of Wax

GPC measurement apparatus: GPC-150C (Waters Co.)

Column: GMH-HT 30 cm 2-series (Tosoh Corporation)

Temperature: at 135° C.

Solvent: o-dichlorobenzene (0.1% lonol is added)

Flow rate: 1.0 ml/min

Sample: 0.4 ml of 0.15% of a sample is injected.

Measurement is carried out under the above described conditions, and in order to calculate the molecular weight of the sample, a molecular weight calibration curve produced using monodisperse polystyrene standardized samples is used. Further, the molecular weight distribution is calculated in terms of polyethylene according to a conversion equation derived from the Mark-Houwink viscosity equation.

(7) Molecular Weight Distribution Measurement of a Binder Resin Raw Material or a Binder Resin Component of Toner The molecular weight on a chromatogram in GPC is measured under the following conditions.

Columns are stabilized in a heat chamber at 40° C. and tetrahydrofuran (THF) as a solvent is allowed to pass through the columns at that temperature at 1 ml/min. In the case of a binder resin raw material, the binder resin raw material is allowed only to pass through a roll mill (130° C. for 15 minutes) to be used as a sample. In the case of a toner to be used as a sample, the toner is dissolved in THF and then filtered through a 0.2 μm filter and the filtered solution is used as a sample. The measurement is carried out by injecting 50 to 200 μl of THF sample solution of a resin whose concentration in the sample is adjusted to 0.05 to 0.6% by weight. At the time of measurement of the molecular weight of the sample, the molecular weight distribution of the sample is computed on the basis of the relation between the logarithmic values of the calibration curve produced using several types of monodisperse polystyrene standardized samples and the counted values. Used as the standardized polystyrene samples for the calibration curve production are those with a molecular weight of about $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, $4.48\times10^6$ produced by Pressure Chemical Co. or Toyo Soda industry Co., Ltd. and at least ten of standardized polystyrene samples are proper to be employed. As a detector, an RI (refractive index) detector is employed.

As columns, a plurality of commercialized polystyrene gel columns may be combined in order to properly measure the molecular weight region of $10^3$ to $2\times10^6$, and for example, preferable combinations are μ-styreagel 500, $10^3$, $10^4$, and $10^5$ manufactured by Waters Co. and Shodex KA-801, 802, 803, 804, 805, 806, and 807 by Showa Denko Co.

(8) Measurement of Particle Diameter Distribution of a Toner

The particle diameter distribution of the present invention is measured using Coulter counter Model TA-II or Coulter Multisizer (produced by Bechman Coulter Co.). As an electrolytic solution, an aqueous 1% NaCl solution is prepared using first grade sodium chloride. For example, ISOTON R-II (produced by Bechman Coulter Co.) may be used. As a measurement method, 0.1 to 5 ml of a surfactant (preferably alkylbenzenesulfonate) is added as a diserpsant to 100 to 150 ml of the foregoing electrolytic solution and 2 to 20 mg of a measurement sample is further added. The electrolytic solution in which the sample is suspended is subjected to dispersion treatment for about 1 to 3 minutes by an ultrasonic dispersion apparatus, and using the foregoing measurement apparatus (aperture: 100 $\mu$m), the volume and the number of the toner particles with 2 $\mu$m or larger are measured, calculating the volume distribution and the number distribution. Then, the weight average particle diameter (D4) by weight (representative values of the respective channels) calculated from the volume distribution relevant to the present invention is found.

The channels used are 13 channels of 2.00 to shorter than 2,52 $\mu$m, 2,52 to shorter than 3.17 $\mu$m, 3.17 to shorter than 4.00 $\mu$m, 4.00 to shorter than 5.04 $\mu$m, 5.04 to shorter than 6.35 $\mu$m, 6.35 to shorter than 8.00 $\mu$m, 8.00 to shorter than 10.08 $\mu$m, 10.08 to shorter than 12.72 $\mu$m, 12.72 to shorter than 16.00 $\mu$m, 16.00 to shorter than 20.02 $\mu$m, 20.02 to shorter than 25.40 $\mu$m, 25.40 to shorter than 32.00 $\mu$m, and 32.00 to shorter than 40.30 $\mu$m.

(9) Measurement of Sulfur Atom Content Contained in Toner

The content of sulfur atoms contained in a toner is measured using EMIA-320 manufactured by Horiba Seisakusho Co., Ltd.

The quantitative measurement is carried out by burning a toner in oxygen current, converting sulfur atoms in sulfur-containing resin in the toner to sulfur dioxide, and measuring the sulfur dioxide by an infrared absorption method to calculate the sulfur atoms.

(10) Measurement of Foreign Element Content in Magnetic Iron Oxide

Foreign elements in a magnetic iron oxide can be measured by fluorescent x-ray analysis according to JIS K0119 fluorescent x-ray analysis standard using fluorescent x-ray analyzer SYSTE 3080 (Rigakku Denki Kogyo Co., Ltd.).

(11) Measurement of Foreign Element Content Distribution in Magnetic Iron Oxide

Regarding the content distribution of foreign elements in a magnetic iron oxide, the element amounts are quantitatively measured by plasma fluorescent distribution (ICP) while the iron oxide is dissolved in hydrochloric acid or hydrofluoric acid, and the dissolution ratio of each element is calculated from each element concentration at the time of the dissolution in relation to the concentration of full dissolution of each element to obtain the distribution.

(12) Measurement of the Number Average Particle Diameter of Magnetic Iron Oxide

The number average particle diameter of magnetic iron oxide can be determined by randomly selecting 300 particles from photographs of magnetic material particles magnified 40,000 times with a transmission type electron microscope and measuring them with a digitizer.

(13) Measurement of Magnetic Properties of Magnetic Iron Oxide

The magnetic properties of the magnetic iron oxide are measured in the external magnetic field of 795.8 kA/m using a sample oscillation type magnetic force measurement apparatus VSM-3S-15 (Tohei Kogyo Co., Ltd.).

(14) Measurement of Specific Surface Area of Magnetic Iron Oxide and External Additives by BET Method The specific surface areas of magnetic Ion oxide and external additives are measured by adsorbing nitrogen gas on the specimen surface according to the BET method using a specific surface area measurement apparatus Autosorb 1 (Yuasa Ionics Co., Ltd.) and the specific surface area is calculated by a BET multiple point method.

Hereinafter, the present invention will be described with the reference to examples, however the present invention is not at all restricted to these examples.

Production of Sulfur-Containing Resin:

PRODUCTION EXAMPLE 1

To a reaction container equipped with a refluxing tubes a stirrer, a thermometer, a nitrogen introduction pipe, a titration apparatus, and a pressure decreasing apparatus and made possible to be pressurized, 200 parts by weight of methanol, 150 parts by weight of 2-butanone, and 50 parts by weight of 2-propanol as solvents were added and 78 parts by weight of styrene, 15 parts by weight of n-butyl acrylate, and 7 parts by weight of 2-acrylamido-2-methylpropanesulfonic acid as monomers were added and heated to 70° C. while being stirred. As a polymerization initiator, a solution containing 20 parts by weight of 2-butanone and 1 part by weight of 2,2'-azobis(2-methylbutyronitrile) diluted in the 2-butanone was dropwise titrated for 1 hour and continuously stirred for 5 hours and further a solution containing 20 parts by weight of 2-butanone and 1 part by weight of 2,2'-azobis(2-methylbutyronitrile) diluted in the 2-butanone was dropwise titrated for 30 minutes and successively stirred for 5 hours to complete polymerization. After the polymerization solvents were distilled in decreased pressure, the obtained polymer was roughly crushed to 100 $\mu$m or smaller by a cutter mill equipped with a screen of 150 meshes.

The obtained sulfur-containing copolymer had the glass transition temperature (Tg) of 74° C., the weight average molecular weight (Mw) of 27,000, and the acid value of 23 mg KOH/g. The obtained sulfur-containing copolymer was denoted as (S-1).

PRODUCTION EXAMPLE 2

A sulfur-containing copolymer (S-2) was obtained in the same manner as the production example 1 except that 70 parts by weight of styrene, 13 parts by weight of n-butyl acrylate, 7 parts by weight of 2-acrylamido-2-methylpropanesulfonic acid, and 0.05 parts by weight of divinyl benzene were added as monomers and 1 part by weight of 2.21-azobis(2-methylbutyronitrile) as a polymerization initiator was dropwise titrated for 90 minutes.

The obtained sulfur-containing copolymer (S-2) had the glass transition temperature (Tg) of 58° C., the weight average molecular weight (Mw) of 174,000, and the acid value of 26 mg KOH/g

PRODUCTION EXAMPLE 3

A sulfur-containing copolymer (S-3) was obtained in the same manner as the production example 1 except that 2,2'-azobis(2-methylbutyronitrile) as a polymerization initiator was added in 4 parts by weight.

The obtained sulfur-containing copolymer (S-3) had the glass transition temperature (Tg) of 57° C., the weight average molecular weight (Mw) of 4,800, and the acid value of 22 mg KOH/g.

PRODUCTION EXAMPLE 4

A sulfur-containing copolymer (S-4) was obtained in the same manner as the production example 1 except that 800 parts by weight of toluene and 100 parts by weight of isopropanol were used as polymerization solvents and 71 parts by weight of styrene, 26 parts by weight of n-butyl acrylate, and 3 parts by weight of 2-acrylamido-2-methylpropanesulfonic acid were used as monomers and 2 parts by weight of 2,2'-azobis(2-methylbutyronitrile) was used as a polymerization initiator and polymerization reaction was carried out for 7 hours at refluxing temperature.

The obtained sulfur-containing copolymer (S-4) had the glass transition temperature (Tg) of 38° C., the weight average molecular weight (Mw) of 22,000, and the acid value of 11 mg KOH/g.

PRODUCTION EXAMPLE 5

A sulfur-containing copolymer (S-5) was obtained in the same manner as the production example 1 except that 50 parts by weight of methanol and 1000 parts by weight of xylene were used as polymerization solvents and 900 parts by weight of styrene and 100 parts by weight of 2-acrylamido-2-methylpropanesulfonic acid were used as monomers and 60 parts by weight of 2,2'-azobis (2,4-dimethyl valeronitrile) was used as a polymerization initiator and polymerization reaction was carried out for 10 hours at 60° C.

The obtained sulfur-containing copolymer (S-5) had the glass transition temperature (Tg) of 96° C., the weight average molecular weight (Mw) of 9,600, and the acid value of 29 mg KOH/g.

PRODUCTION EXAMPLE 6

A sulfur-containing copolymer (S-6) was obtained in the same manner as the production example 1 except that 70 parts by weight of styrene, 18 parts by weight of n-butyl methacrylate, and 12 parts by weight of 2-acrylamido-2-methylpropanesulfonic acid were used as monomers.

The obtained sulfur-containing copolymer (S-6) had Tg of 78° C., the weight average molecular weight (Mw) of 10,500, and the acid value of 37 mg KOH/g.

PRODUCTION EXAMPLE 7

A sulfur-containing copolymer (S-7) was obtained by changing the production example 1 as follows: 200 parts by weight of xylene was used as a polymerization solvent and 43 parts by weight of styrene and 7 parts by weight of 2-acrylamido-2-methylpropanesulfonic acid were used as monomers and 3 parts by weight of 1,1-bis (tert-butylperoxy)-2-methylcyclohexane as a polymerization initiator was dropwise titrated and kept at the temperature for 8 hours for a first step polymerization. Then, in a second step polymerization, a monomer composition containing 30 parts by weight of styrene, 20 parts by weight of n-butyl acrylate, and 50 parts by weight of xylene was dropwise added for 1 hour to the reaction container heated to 120° C. and the temperature was kept for 5 hours to complete the polymerization reaction xylene was distilled in decreased pressure to obtain the sulfur-containing copolymer (S-7).

The obtained sulfur-containing copolymer (S-7) had Tg of 77° C., the weight average molecular weight (Mw) of 26,000, and the acid value of 24 mg KOH/g

PRODUCTION EXAMPLE 8

A sulfur-containing copolymer (S-8) was obtained in the same manner as the production example 1 except that a reaction container was loaded with 70 parts by weight of styrene, 27 parts by weight of n-butyl acrylate, 3 parts by weight of 2-acrylamido-2-methylpropanesulfonic acid without adding any polymerization solvent and polymerization initiator and heated to 120° C. and then bulk polymerization was carried out for 8 hours. After that, 50 parts by weight of xylene was added and the temperature was decreased to 110° C. and 50 parts by weight of a xylene solution containing 1 parts by weight of tert-butylperoxy-2-ethylhexanoate dissolved therein was dropwise titrated for 6 hours and further 1 hour-stirring was carried out to obtain the sulfur-containing copolymer (S-8).

The obtained sulfur-containing copolymer (S-8) had the Tg of 56° C., the weight average molecular weight (Mw) of 271,000, and the acid value of 8 mg KOH/g.

PRODUCTION EXAMPLE 9

A sulfur-containing copolymer (S-9) was obtained in the same manner as the production example 1 except that a monomer mixture containing 93 parts by weight of 4-tert-butylstyrene and 7 parts by weight of 2-acrylamido-2-methylpropanesulfonic acid was used.

The obtained sulfur-containing copolymer (S-9) had Tg of 133° C., the weight average molecular weight (Mw) of 14,000, and the acid value of 19 mg KOH/g.

PRODUCTION EXAMPLE 10

A sulfur-containing copolymer (S-10) was obtained in the same manner as the production example 1 except that 300 parts by weight of methanol and 100 parts by weight of toluene were used as polymerization solvents, 540 parts by weight of styrene and 60 parts by weight of 2-acrylamido-2-methylpropanesulfonic acid were used as monomers, and 60 parts by weight of lauroylperoxide was used as a polymerization initiator and polymerization reaction was carried out at refluxing temperature for 10 hours.

The obtained sulfur-containing copolymer (S-10) had Tg of 28° C., the weight average molecular weight (Mw) of 1,900, and the acid value of 36 mg KOH/g.

Table 3 shows the physical properties of sulfur-containing copolymers (S-1) to (S-10).

RESIN PRODUCTION EXAMPLE 1

(1) Polyester Resin Production terephthalic acid:6.1 mol dodecenylsucclnic anhydride:3.0 mol fumaric acid:0.8 mol trimellitic acid anhydride:3.1 mol PO-BPA (propoxylated bisphenol A):7.2 mol EO-BPA (ethoxylated bisphenol A):3.0 mol An autoclave was loaded with the above described polyester monomers together with an esterification catalyst, providing a pressure decreasing apparatus, a water separation apparatus, a nitrogen gas introduction apparatus, a temperature measurement apparatus, and a stirring apparatus and condensation polymerization was carried out in nitrogen gas atmosphere while heating the contents to 210° C. to obtain polyester resin (PE). The obtained polyester resin (PE) had the main peak molecular weight of 7,150, Mw of 25.000, Mw/Mn of 3.4, the acid value of 29.3 mg KOH/g, and Tg of 60° C.

(2) Hybrid resin component production

The above described polyester resin (PE) in 80 parts by weight was dissolved and swollen in 100 parts by weight of xylene. Next, 15 parts by weight of styrene, 5 parts by weight of 2-ethylhexyl acrylate, 7 parts by weight of a wax (1), and 0.1 parts by weight of dibutyltin oxide as an esterification catalyst were added and heated to the refluxing temperature of xylene to start esterification exchange reaction of the carboxylic acid of the polyester resin and 2-ethylhexyl acrylate. Further, a xylene solution produced by dissolving 1 part by weight of tert-butylhydroperoxide as a radical polymerization initiator in 30 parts by weight of xylene was dropwise titrated for about 1 hour. The resulting mixture was kept at the temperature for 6 hours to complete the radical polymerization reaction and then heated to 210° C. In decreased pressure to remove the solvents and to carry out esterification exchange reaction between the hydroxyl groups of the polyester resin and 2-ethylhexyl acrylate, which is a copolymerization monomer of a vinyl type polymer unit and a resin composition (H-1) containing the binder resin composed of polyester resin, the vinyl type polymer, and hybrid resin produced by the polyester unit and the vinyl type polymer unit bonded by esterification and the wax (1) evenly mixed with the binder resin was obtained in such a manner.

The obtained resin composition (H-1) had the acid value of 28 mg XOH/g, Tg of 59° C., the main peak molecular weight of 7,300, the weight average molecular weight (Mw) of 43,000, and Mw/Mn of 8.5, and contained THF-insoluble matter of about 13% by weight.

RESIN PRODUCTION EXAMPLES 2 to 5

Resin compositions (H-2) to (H-5) were obtained in the same manner as the resin production example 1, except that respectively 7 parts by weight of waxes (2) to (5) shown in Table 4 were added in place of the wax (1).

RESIN PRODUCTION EXAMPLE 6

Resin composition (H-6) was obtained in the same manner as the resin production example 1, except that 3 parts by weight of the wax (1) and 3 parts by weight of the wax (3) shown in Table 4 were added in place of the wax (1).

RESIN PRODUCTION EXAMPLE 7

Resin composition (H-7) was obtained in the same manner as the resin production example 1, except that 3 parts by weight of the wax (3) and 3 parts by weight of the wax (5) shown in Table 4 were added in place of the wax (1).

RESIN PRODUCTION EXAMPLE 8

Resin composition (H-8) was obtained in the same manner as the resin production example 1, except that the wax (1) was not added at the time of producing the hybrid resin.

RESIN PRODUCTION EXAMPLE 9

Resin composition (H-9) was obtained in the same manner as the resin production example 1, except that monomers composing the polyester resin were used as follows:

| | |
|---|---|
| terephthalic acid | 6.0 mol |
| dodecenylsuccinic anhydride | 1.0 mol |
| fumaric acid | 2.0 mol |

-continued

| | |
|---|---|
| trimellitic acid anhydride | 6.0 mol |
| PO-BPA (propoxylated bisphenol A) | 7.0 mol |
| EO-BPA (ethoxylated bisphenol A) | 3.0 mol |

The obtained resin composition (H-9) had the acid value of 46 mg KOH/g, Tg of 57° C., the main peak molecular weight of 10,600, Mw of 167,000, Mw/Mn of 42, and contained about 15% by weight of THF-insoluble matter.

RESIN PRODUCTION EXAMPLE 10

Resin composition (H-10) was obtained in the same manner as the resin production example 1, except that the polyester resin (1) used in the production example 1 was added in 90 parts by weight and as the vinyl type monomer styrene and 2-ethylhexyl acrylate were added in 7 parts by weight and 3 parts by weight, respectively.

The obtained resin composition (H-10) had the acid value of 35 mg KOH/g, Tg of 61° C., the main peak molecular weight of 8,300, the weight average molecular weight (Mw) of 419,000, Mw/Mn of 18, and contained about 12% by weight of THF-insoluble matter.

RESIN PRODUCTION EXAMPLE 11

Resin composition (H-1) was obtained in the same manner as the resin production example 1, except that the polyester resin (1) used in the production example 1 was added in 50 parts by weight and as the vinyl type monomer styrene and 2-ethylhexyl acrylate were added in 35 parts by weight and 15 parts by weight, respectively.

The obtained resin composition (H-11) had the acid value of 16 mg KOH/g, Tg of 60° C., the main peak molecular weight of 6,400, the weight average molecular weight (Mw) of 1,360,000, Mw/Mn of 215, and contained about 6% by weight of THF-insoluble matter.

RESIN PRODUCTION EXAMPLE 12

While being stirred, together with an esterification catalyst, the following polyester monomers and vinyl type monomers were dropwise titrated for 4 hours at 130° C. In nitrogen atmosphere through a titration funnel to a flask having 4 necks and equipped with a pressure decreasing apparatus, a water separation apparatus, a nitrogen gas introduction apparatus, a temperature measurement apparatus, and a stirring apparatus:

| | |
|---|---|
| polyester monomers | |
| PO-BPA (propoxylated bisphenol A) | 3.0 mol |
| EO-BPA (ethoxylated bisphenol A) | 1.3 mol |
| terephthalic acid | 1.7 mol |
| trimellitic acid anhydride | 1.2 mol |
| dodecenylsuccinic acid anhydride | 1.5 mol |
| vinyl type monomers | |
| styrene | 4.5 mol |
| 2-ethylhexyl acrylate | 0.56 mol |
| azobisisobutyronitrile (a vinyl polymerization initiator) | 0.12 mol |

While being kept at 130° C., the contents in the 4-necked flask were further continuously heated for 3 hours (to complete the vinyl type polymerization reaction) and then the temperature was heated to 230° C. and condensation polymerization was carried out while the pressure being decreased. On the completion of the reaction, the reaction products were taken out, cooled, and pulverized to obtain a resin composition (H-12) containing polyester resin, the vinyl type polymer, and hybrid resin composed of the polyester unit and the vinyl type polymer unit. The obtained resin composition (E-12) had the acid value of 22 mg KOH/g, Tg of 60.5° C., the main peak molecular weight of 8,700, the weight average molecular weight (Mw) of 75,000, and Mw/Mn of 20, and contained THE-insoluble matter of 22% by weight.

COMPARATIVE PRODUCTION EXAMPLE

To an autoclave equipped with a pressure decreasing apparatus, a water separation apparatus, a nitrogen gas introduction apparatus, a temperature measurement apparatus, and a stirring apparatus, 250 parts by weight of terephthalic acid, 30 parts by weight of trimellitic acid, 193 parts by weight of EO-BPA, 840 parts by weight of PO-BPA and 2 parts by weight of dibutyltin oxide were added in the presence of 200 parts by weight of a styrene copolymer (SR) (the number average molecular weight of 8,000 and Mw/Mn=2.7) containing 84 parts by weight of styrene and 16 parts by weight of 2-ethylhexyl acrylate and heated to 200° C. In nitrogen atmosphere while the pressure being decreased and condensation polymerization reaction was carried out to obtain a comparative resin composition (RH-1).

The obtained comparative resin composition (RH-1) had the acid value of 1 mg KOH/g, Tg of 61.4° C., the peak molecular weight of 20,800, the weight average molecular weight (Mw) of 45,000, and Mw/Mn of 6.3 and contained THF-insoluble matter of not more than 1% by weight and no hybrid resin.

EXAMPLE 1

Resin composition (H-1) 100 parts by weight

Sulfur-containing copolymer (S-1) 2 parts by weight

Charge controlling agent (an organoaluminum compound composed of 2 moles of 3,5-di-tert-butylsalioylic acid and 1 mole of aluminum atom) 1 part by weight Magnetic iron oxide (the average particle diameter of 0.18 $\mu$m, coercive force 10.7 kA/m, residual magnetization 11.2 $Am^2/kg$, and saturation magnetization 81.5 $Am^2/kg$) 90 parts by weight The above described mixture was melted and kneaded by a biaxial kneader heated to 130° C. and the cooled mixture was roughly pulverized by a hammer mill. The roughly pulverized product was finely pulverized by a turbo mill T-250 Model (Turbo industry Co., Ltd.) and the obtained finely pulverized product was classified by an air classifier to obtain magnetic toner particles having the weight average particle diameter of 7.7 $\mu$m and containing 6.6% by volume of particles with the particle diameter of 10.1 $\mu$m or larger.

To 100 parts by weight of the magnetic toner particles, 1.0 part by weight of hydrophobic dry process silica fine powder (BET specific surface area of 200 $m^2/g$) was externally added by a Henschel mixer to obtain a magnetic toner (1). The respective physical properties of the magnetic toner (1) are shown in Table 5. The development property and the fixing performance were evaluated using the magnetic toner (1).

The development property evaluation of the toner was carried out by carrying out a 100,000 sheets durability image evaluation test by using a digital copying apparatus iR-6000 manufactured by Canon, which employs electrophotographic process and a thermally pressurizing and fixing method, in high temperature and humidity environments (30° C. and 80% RH) and the fogging of images and the stability of the quality and the image density was evaluated.

Fogging measurement for images and evaluation ratings The reflectance (%) of white parts (non-image formed parts) of images to be subjected to the fogging evaluation and the reflectance (%) of un-used paper were measured by reflectance measurement apparatus REFLECTMETER (Tokyo Denshoku Co., Ltd.) for fogging measurement and the difference between both (the reflectance of the un-used paper—the reflectance of the white parts of images) was defined as the fogging Rate 5: fogging lower than 0.1%;

Rate 4: fogging not lower than 0.1 and lower than 0.5%;

Rate 3: fogging not lower than 0.5 and lower than 1.5%;

Rate 2: fogging not lower than 1.5 and lower than 2.0%; and

Rate 1: fogging not lower than 2.0%.

Evaluation Method of Images and Evaluation Ratings

Rate 5: images with precisely similar to original one;

Rate 4: images with more or less scattering observed when the images were magnified by a magnifying lens;

Rate 3: images with scattering and disorder observed when the images were magnified by a magnifying lens;

Rate 2: images with scattering and image disorder observed visually: and

Rate 1: images did not regenerate the original one.

Image Density Stabilization of a Toner

The image density stability of a toner was evaluated as follows: a 100,000 sheets durability test was carried out using a digital copying apparatus iR-6000 manufactured by Canon in normal temperature and normal humidity environments (23° C. and 60% RH) and the final image density (F) was measured. The developing apparatus was taken out the copying apparatus and left for 48 hours in a high temperature and high humidity chamber (30° C., 80% RH). When the developing apparatus was left in the high temperature and high humidity environments, the developing apparatus was wrapped in order to prevent dew formation and after the temperature and humidity were adjusted for 5 hours or longer, the sealing was opened. After being left still, the developing apparatus was taken out in the normal temperature and normal humidity environments and installed in the iR-6000 Model. After the developing sleeve was rotated for 1 minute, 10 sheets of evaluation images were sampled and the average value of the image densities was defined as the density (R) after standstill and the toner charging property of a toner was evaluated based on the difference ((F)−(R)) of the image density (F) before standstill and the image density (R) after standstill. The evaluation ratings were as follows:

Rate 5: the value of (F)−(R) is 0 to less than 0.05

Rate 4: the value of (F)−(R) is 0.05 or higher to less than 0.10

Rate 3: the value of (F)−(R) is 0.10 or higher to less than 0.15

Rate 2: the value of (F)−(R) is 0.15 or higher to less than 0.20

Rate 1: the value of (F)−(R) is 0.20 or higher

Fixing Performance Evaluation of a Toner

The fixing performance of a toner was evaluated by carrying out a fixing performance test using a fixing performance testing apparatus produced by taking out a fixing apparatus of a copying apparatus NP6085 manufactured by Canon and equipped with an external driving apparatus and a temperature control apparatus for the fixing apparatus by passing a half-tone image area (the image density: 0.6) while changing the temperature of the fixing apparatus.

The fixing lower limit temperature was set to be the temperature at which the decrease ratio of image density became 20% or lower before and after scrubbing a fixed image by soft and thin paper while applying load of 4,900 N/nm (50 g/cm$^2$) to the fixed image. The fixing upper limit temperature was evaluated based on the temperature at which hot-off-set occurrence on the transfer sheet was observed visually.

As the results of these evaluation shown in Table 6 made it clear that remarkably excellent results were obtained.

EXAMPLES 2 to 7

Magnetic toners (2) to (7) were produced in the same manner as the Example 1, except that the sulfur-containing copolymers shown in Table 3 were used. The respective physical properties of the obtained magnetic toners are shown in Table 5. The results of the evaluation of the magnetic toners carried out in the same manner as that in the Example 1 are shown in Table 6.

EXAMPLES 8 to 13

Magnetic toners (8) to (13) were produced in the same manner as the Example 1, except that the resin compositions (H-2) to (H-7) were used as binder resin. The respective physical properties of the obtained magnetic toners are shown in Table 5. The results of the evaluation of the magnetic toners carried out in the same manner as that of the Example 1 are shown in Table 6.

EXAMPLE 14

A magnetic toner (14) was produced in the same manner as the Example 1, except that the resin composition (H-8) was used as binder resin and at the time of kneading 7 parts by weight of the wax (3) was added. The respective physical properties of the obtained magnetic toner are shown in Table 5. The results of the evaluation of the magnetic toner carried out in the same manner as that of the Example 1 are shown in Table 6.

EXAMPLES 15 to 17

Magnetic toners (15) to (17) shown in Table 5 were produced in the same manner as the Example 1, except that the binder resin and toner particle diameter were changed. The respective physical properties of the obtained magnetic toners are shown in Table 5. The results of the evaluation of the magnetic toners carried out in the same manner as that of the Example 1 are shown in Table 6.

EXAMPLES 18 to 20

Magnetic toners (18) to (20) were produced in the same manner as the Example 1, except that the addition amounts of the sulfur-containing copolymers were changed. The respective physical properties of the obtained magnetic toners are shown in Table 5. The results of the evaluation of the magnetic toners are shown in Table 6.

EXAMPLE 21

A magnetic toner (21) shown in Table 5 was produced in the same manner as the Example 1, except that no charge control agent (the organoaluminum compound composed of 2 moles of 3,5-di-tert-butylsalicylic acid and 1 mole of aluminum atom) was used. The results of the evaluation of the magnetic toner carried out in the same manner as that of the Example 1 are shown in Table 6.

EXAMPLES 22 to 24

Magnetic toners (22) to (24) were produced in the same manner as the Example 1, except that the sulfur-containing copolymers (S-8) to (S-10) were used. The respective physical properties of the obtained magnetic toners are shown in Table 5. The results of the evaluation of the magnetic toners are shown in Table 6.

EXAMPLE 25

A magnetic toner (25) was produced in the same manner as the Example 1, except that the binder resin was changed to be the resin composition (H-12). The respective physical properties of the obtained magnetic toner are shown in Table 5. The results of the evaluation of the magnetic toner carried out in the same manner as that of the Example 1 are shown in Table 6.

COMPARATIVE EXAMPLE 1

A comparative magnetic toner (1) was produced in the same manner as the Example 1, except that the comparative binder resin (RH-1) was used. The respective physical properties of the obtained magnetic toner are shown in Table 5. The results of the evaluation of the magnetic toner carried out in the same manner as that of the Example 1 are shown in Table

COMPARATIVE EXAMPLE 2

A comparative magnetic toner (2) was produced in the same manner as the Example 1, except that no sulfur-containing copolymer was added and an organozinc compound composed of 3,5-di-tert-butylsalicylic acid and zinc atom was used as a charge control agent. The respective physical properties of the obtained magnetic toner (2) are shown in Table 5. The results of the evaluation are shown in Table 6.

COMPARATIVE EXAMPLE 3

A comparative magnetic toner (3) was produced in the same manner as the Example 14, except that polyester resin (PE) (Mw=25,000) produced by the resin production example 1 was used as the binder resin. The respective physical properties of the obtained comparative magnetic toner (3) are shown in Table 5 and the results of the evaluation are shown in Table 6.

COMPARATIVE EXAMPLE 4

A comparative magnetic toner (4) was produced in the same manner as the Example 14, except that styrene-2-ethylhexyl acrylate copolymer (SR) (copolymerization weight ratio=84:16; Mn=8,000; Mw/Mn=2.7) produced by the comparative production example was used as the binder resin. The respective physical properties of the obtained comparative magnetic toner (4) are shown in Table 5 and the results of the evaluation are shown in Table 6.

TABLE 1

| | Low-peak molecular-weight wax | High-peak molecular-weight wax | Mixed wax |
|---|---|---|---|
| EX. (1) | Main-peak molecular-weight 1,000; Mw/Mn = 1.5; Hydrocarbon wax having an endothermic peak temperature of ca. 105° C. | Main-peak molecular-weight 3,000; Mw/Mn = 9; Polypropylene wax having an endothermic peak temperature of ca. 145° C. | Main-peak molecular-weight 1,000; Mw/Mn = 9.1 |
| EX. (2) | Main-peak molecular-weight 800; Mw/Mn = 2.0; Wax of Formula (2) containing a hydroxyl group group and endothermic peak temperature of ca. 100° C. | Main-peak molecular-weight 3,000; Mw/Mn = 9; Polypropylene wax having an endothermic peak temperature of ca. 145° C. | Main-peak molecular-weight 700; Mw/Mn = 9.3 |
| EX. (3) | Main-peak molecular-weight 800; Mw/Mn = 2.0; Wax of Formula (2) containing a hydroxyl group and having an endothermic peak temperature of ca. 100° C. | Main-peak molecular-weight 1,000; Mw/Mn = 1.5; Hydrocarbon wax having an endothermic peak temperature of ca. 105° C. | Main-peak molecular-weight 700; Mw/Mn = 2.2 |
| EX. (4) | Main-peak molecular-weight 500; Mw/Mn = 1.3; Paraffin wax having an endothermic peak temperature of ca. 80° C. | Main-peak molecular-weight 1,000; Mw/Mn = 1.5; Hydrocarbon wax having an endothermic peak temperature of ca. 105° C. | Main-peak molecular-weight 500; Mw/Mn = 1.6 |
| EX. (5) | Main-peak molecular-weight 500; Mw/Mn = 1.3; Paraffin wax having an endothermic peak temperature of ca. 80° C. | Main-peak molecular-weight 3,000; Mw/Mn = 9; Polypropylene wax having an endothermic peak temperature of ca. 145° C. | Main-peak molecular-weight 500; Mw/Mn = 8.7 |
| EX. (6) | Main-peak molecular-weight 500; Mw/Mn = 1.3; Paraffin wax having an endothermic peak temperature of ca. 80° C. | Main-peak molecular-weight 800; Mw/Mn = 2.0; Wax of Formula (2) containing a hydroxyl group and having an endothermic peak temperature of ca. 100° C. | Main-peak molecular-weight 500; Mw/Mn = 1.7 |

TABLE 2

| | New-detected | Signal of carboxyl group of aliphatic dicarboxylic acid | | Signal of carboxyl group of |
|---|---|---|---|---|
| | signal ca. 168 ppm | ca. 172 ppm | ca. 174 ppm | acrylic acid ester ca. 176 ppm |
| Polyester | — | ○ | ○ | — |
| Vinyl polymer | — | — | — | ○ |
| Hybid resin | ○ | ○ | ○ | ○ |

TABLE 3

| Sulfur-contg. copolymer | Weight-average molecular weight | Glass transition temperature (° C.) | Acid value (mg KOH/g) |
|---|---|---|---|
| S-1 | 27,000 | 74 | 23 |
| S-2 | 174,000 | 58 | 26 |
| S-3 | 4,800 | 57 | 22 |
| S-4 | 22,000 | 38 | 11 |
| S-5 | 9,600 | 96 | 29 |
| S-6 | 10,500 | 78 | 37 |
| S-7 | 26,000 | 77 | 24 |
| S-8 | 271,000 | 56 | 8 |
| S-9 | 14,000 | 133 | 19 |
| S-10 | 1,900 | 28 | 36 |

TABLE 4

| | Kinds of wax | Peak molecular weight | Mw/Mn | Endothermic main peak temperature | Endothermic sub-peak temperature |
|---|---|---|---|---|---|
| Wax (1) | Paraffin wax | 1,060 | 1.2 | 83° C. | Not measured |
| Wax (2) | Polyethylene wax | 2,100 | 1.3 | 103° C. | Not measured |
| Wax (3) | Hydrocarbon wax | 2,200 | 1.2 | 106° C. | Not measured |
| Wax (4) | Wax of Formula (2) (A = hydroxyl, x = ca. 50) | 1,650 | 1.8 | 108° C. | Not measured |
| Wax (5) | Polypropylene wax (copolymerized with ca. 5% of ethylene) | 16,700 | 5.7 | 141° C. | Not measured |

TABLE 5

| | Toner No. | Binder Resin | Sulfur-contg. copolymer Kind | Sulfur-contg. copolymer Amount (Part by weight) | Organometallic compound Amount (Part by weight) | Acid value of toner (mg KOH/g) | THF-insoluble matter (% by weight) | Molecular weight and molecular weight distribution of THF-soluble matter: Main peak molecular weight | Mz | Mz/Mw |
|---|---|---|---|---|---|---|---|---|---|---|
| Ex. 1 | 1 | H-1 | S-1 | 2 | 1 | 15 | 12 | 7100 | $0.3 \times 10^8$ | 64 |
| Ex. 2 | 2 | H-1 | S-2 | 2 | 1 | 15 | 12 | 7100 | $0.3 \times 10^8$ | 64 |
| Ex. 3 | 3 | H-1 | S-3 | 2 | 1 | 15 | 12 | 7100 | $0.3 \times 10^8$ | 64 |
| Ex. 4 | 4 | H-1 | S-4 | 2 | 1 | 15 | 12 | 7100 | $0.3 \times 10^9$ | 64 |
| Ex. 5 | 5 | H-1 | S-5 | 2 | 1 | 15 | 12 | 7100 | $0.3 \times 10^8$ | 64 |
| Ex. 6 | 6 | H-1 | S-6 | 2 | 1 | 15 | 12 | 7100 | $0.3 \times 10^8$ | 64 |
| Ex. 7 | 7 | H-1 | S-7 | 2 | 1 | 15 | 12 | 7100 | $0.3 \times 10^8$ | 64 |
| Ex. 8 | 8 | H-2 | S-1 | 2 | 1 | 15 | 12 | 7100 | $0.3 \times 10^8$ | 64 |
| Ex. 9 | 9 | H-3 | S-1 | 2 | 1 | 15 | 12 | 7100 | $0.3 \times 10^8$ | 64 |
| Ex. 10 | 10 | H-4 | S-1 | 2 | 1 | 15 | 12 | 7100 | $0.3 \times 10^8$ | 64 |
| Ex. 11 | 11 | H-5 | S-1 | 2 | 1 | 15 | 12 | 7100 | $0.3 \times 10^8$ | 64 |
| Ex. 12 | 12 | H-6 | S-1 | 2 | 1 | 15 | 12 | 7100 | $0.3 \times 10^8$ | 64 |
| Ex. 13 | 13 | H-7 | S-1 | 2 | 1 | 15 | 12 | 7100 | $0.3 \times 10^8$ | 64 |
| Ex. 14 | 14 | H-8 | S-1 | 2 | 1 | 15 | 12 | 7100 | $0.3 \times 10^8$ | 64 |
| Ex. 15 | 15 | H-9 | S-1 | 2 | 1 | 23 | 41 | 11700 | $1.9 \times 10^8$ | 113 |
| Ex. 16 | 16 | H-10 | S-1 | 2 | 1 | 19 | 33 | 9200 | $1.2 \times 10^9$ | 62 |
| Ex. 17 | 17 | H-11 | S-1 | 2 | 1 | 7 | 8 | 6600 | $0.3 \times 10^8$ | 31 |
| Ex. 18 | 18 | H-1 | S-1 | 0.5 | 1 | 15 | 12 | 7100 | $0.3 \times 10^8$ | 64 |
| Ex. 19 | 19 | H-1 | S-1 | 1 | 1 | 15 | 12 | 7100 | $0.3 \times 10^8$ | 64 |
| Ex. 20 | 20 | H-1 | S-1 | 8 | 1 | 15 | 12 | 7100 | $0.3 \times 10^8$ | 64 |
| Ex. 21 | 21 | H-1 | S-1 | 2 | 0 | 15 | 5 | 6800 | $1.1 \times 10^8$ | 109 |
| Comp. Ex. 1 | Comp. 1 | RH-1 | S-1 | 2 | 1 | 15 | 12 | 7100 | $3.1 \times 10^8$ | 164 |
| Ex. 22 | 22 | H-1 | S-8 | 2 | 1 | 15 | 12 | 7100 | $0.3 \times 10^8$ | 64 |
| Ex. 23 | 23 | H-1 | S-9 | 2 | 1 | 15 | 12 | 7100 | $0.3 \times 10^8$ | 64 |
| Ex. 24 | 24 | H-1 | S-10 | 2 | 1 | 15 | 12 | 7100 | $0.3 \times 10^8$ | 64 |
| Comp. Ex. 2 | Comp. 2 | H-1 | — | — | 3 | 15 | 12 | 7100 | $0.3 \times 10^8$ | 64 |
| Comp. Ex. 3 | Comp. 3 | ER | S-1 | 2 | 1 | 17.3 | 3 | 7150 | $0.4 \times 10^6$ | 11 |
| Comp. Ex. 4 | Comp. 4 | SR | S-1 | 2 | 1 | 0.1 | 0.5 | 9500 | $0.2 \times 10^6$ | 5 |
| Ex. 25 | 25 | H-12 | S-1 | 2 | 1 | 14 | 15 | 8700 | $0.2 \times 10^8$ | 55 |

| | Toner No. | Particle diameter and particle size distribution of toner: Weight average diameter (μm) | Number of 10.1 μm or more particles (% by volume) | Toner Tg (° C.) | Endothermic main peak in DSC curve of toner (° C.) | Content of sulfur atom in toner |
|---|---|---|---|---|---|---|
| Ex. 1 | 1 | 7.7 | 6.6 | 59 | 82 | 100 |
| Ex. 2 | 2 | 7.7 | 6.6 | 58 | 82 | 100 |
| Ex. 3 | 3 | 7.7 | 6.6 | 58 | 82 | 100 |
| Ex. 4 | 4 | 7.7 | 6.6 | 56 | 82 | 50 |
| Ex. 5 | 5 | 7.7 | 6.6 | 60 | 82 | 150 |
| Ex. 6 | 6 | 7.7 | 6.6 | 59 | 82 | 180 |
| Ex. 7 | 7 | 7.7 | 6.6 | 58 | 82 | 100 |
| Ex. 8 | 8 | 7.7 | 6.6 | 59 | 102 | 100 |
| Ex. 9 | 9 | 7.7 | 6.6 | 59 | 105 | 100 |
| Ex. 10 | 10 | 7.7 | 6.6 | 59 | 107 | 100 |
| Ex. 11 | 11 | 7.7 | 6.6 | 59 | 140 | 100 |
| Ex. 12 | 12 | 7.7 | 6.6 | 59 | 107 | 100 |
| Ex. 13 | 13 | 7.7 | 6.6 | 59 | 140 | 100 |
| Ex. 14 | 14 | 7.7 | 6.6 | 60 | 106 | 100 |
| Ex. 15 | 15 | 7.8 | 13.6 | 57 | 82 | 100 |
| Ex. 16 | 16 | 7.7 | 8.8 | 61 | 82 | 100 |
| Ex. 17 | 17 | 7.5 | 9.3 | 60 | 82 | 100 |
| Ex. 18 | 18 | 7.7 | 6.6 | 59 | 82 | 100 |
| Ex. 19 | 19 | 7.7 | 6.6 | 59 | 82 | 100 |
| Ex. 20 | 20 | 7.7 | 6.6 | 59 | 82 | 100 |
| Ex. 21 | 21 | 7.4 | 8.3 | 59 | 82 | 100 |
| Comp. Ex. 1 | Comp. 1 | 7.7 | 6.6 | 61 | — | 100 |
| Ex. 22 | 22 | 7.7 | 6.6 | 59 | 82 | 20 |
| Ex. 23 | 23 | 7.7 | 6.6 | 58 | 82 | 90 |
| Ex. 24 | 24 | 7.7 | 6.6 | 60 | 82 | 140 |
| Comp. Ex. 2 | Comp. 2 | 7.7 | 6.6 | 59 | 82 | 0 |
| Comp. Ex. 3 | Comp. 3 | 7.7 | 6.6 | 60 | 106 | 100 |
| Comp. Ex. 4 | Comp. 4 | 7.7 | 6.6 | 59 | 103 | 100 |
| Ex. 25 | 25 | 7.8 | 6.8 | 59 | 105 | 100 |

TABLE 6

| | Evaluation on developing performance of toner | | | | | | | Evaluation on fixing performance of toner | |
|---|---|---|---|---|---|---|---|---|---|
| | Initial stage of running test | | | When running test completed | | | Image | | |
| | Image density | Fog rating | Image quality rating | Image density | Fog rating | Image quality rating | density stability rating | Minimum fixing temperature | Offset-occurrence temperature |
| Ex. 1 | 1.44 | 5 | 5 | 1.42 | 5 | 5 | 5 | 140° C. | No offset occurred |
| Ex. 2 | 1.42 | 4 | 4 | 1.33 | 4 | 4 | 4 | 140° C. | No offset occurred |
| Ex. 3 | 1.37 | 5 | 4 | 1.36 | 4 | 4 | 5 | 140° C. | No offset occurred |
| Ex. 4 | 1.41 | 4 | 5 | 1.30 | 4 | 4 | 3 | 140° C. | No offset occurred |
| Ex. 5 | 1.40 | 4 | 4 | 1.37 | 4 | 5 | 5 | 140° C. | No offset occurred |
| Ex. 6 | 1.42 | 4 | 4 | 1.41 | 4 | 5 | 5 | 140° C. | No offset occurred |
| Ex. 7 | 1.40 | 5 | 5 | 1.40 | 5 | 5 | 5 | 140° C. | No offset occurred |
| Ex. 8 | 1.45 | 4 | 5 | 1.36 | 5 | 5 | 3 | 130° C. | Offset occurred at 220° C. |
| Ex. 9 | 1.42 | 5 | 5 | 1.36 | 4 | 4 | 4 | 140° C. | No offset occurred |
| Ex. 10 | 1.44 | 5 | 5 | 1.38 | 5 | 5 | 5 | 140° C. | Offset occurred at 230° C. |
| Ex. 11 | 1.41 | 5 | 5 | 1.39 | 5 | 5 | 5 | 150° C. | No offset occurred |
| Ex. 12 | 1.43 | 4 | 5 | 1.37 | 5 | 5 | 4 | 130° C. | Offset occurred at 230° C. |
| Ex. 13 | 1.42 | 4 | 5 | 1.40 | 5 | 5 | 5 | 140° C. | No offset occurred |
| Ex. 14 | 1.42 | 4 | 4 | 1.34 | 4 | 4 | 4 | 140° C. | Offset occurred at 230° C. |
| Ex. 15 | 1.44 | 4 | 4 | 1.40 | 4 | 4 | 5 | 150° C. | No offset occurred |
| Ex. 16 | 1.43 | 4 | 4 | 1.40 | 5 | 5 | 5 | 150° C. | No offset occurred |
| Ex. 17 | 1.40 | 5 | 5 | 1.33 | 4 | 4 | 4 | 140° C. | Offset occurred at 230° C. |
| Ex. 18 | 1.44 | 5 | 5 | 1.32 | 3 | 3 | 3 | 140° C. | No offset occurred |
| Ex. 19 | 1.44 | 5 | 5 | 1.37 | 4 | 4 | 4 | 140° C. | No offset occurred |
| Ex. 20 | 1.44 | 4 | 4 | 1.43 | 4 | 4 | 5 | 140° C. | No offset occurred |
| Ex. 21 | 1.38 | 4 | 4 | 1.36 | 4 | 4 | 5 | 140° C. | No offset occurred |
| Comp. Ex. 1 | 1.26 | 2 | 2 | 1.09 | 3 | 2 | 2 | 160° C. | No offset occurred |
| Ex. 22 | 1.34 | 3 | 3 | 1.21 | 3 | 3 | 3 | 140° C. | No offset occurred |
| Ex. 23 | 1.38 | 3 | 3 | 1.23 | 3 | 3 | 2 | 140° C. | No offset occurred |
| Ex. 24 | 1.31 | 3 | 3 | 1.26 | 2 | 2 | 3 | 140° C. | No offset occurred |
| Comp. Ex. 2 | 1.29 | 2 | 2 | 1.11 | 1 | 1 | 1 | 140° C. | No offset occurred |
| Comp. Ex. 3 | 1.28 | 2 | 2 | 1.05 | 2 | 2 | 2 | 150° C. | Offset occurred at 210° C. |
| Comp. Ex. 4 | 1.25 | 3 | 2 | 1.03 | 2 | 1 | 1 | 160° C. | Offset occurred at 210° C. |
| Ex. 25 | 1.44 | 5 | 5 | 1.43 | 5 | 5 | 5 | 140° C. | No offset occurred |

What is claimed is:

1. A toner comprising toner particles and an inorganic fine powder; wherein the toner particles comprise at least a binder resin, a colorant, a sulfur-containing resin, and a wax; wherein the binder resin contains a hybrid resin component containing a vinyl type polymer unit and a polyester unit; the sulfur-containing resin is a resin selected from the group consisting of sulfur-containing polymers and sulfur-containing copolymers; the sulfur-containing resin has a weight average molecular weight (Mw) of 2,000 to 200,000; the sulfur-containing resin has a glass transition temperature (Tg) of 30 to 120° C.; and the wax has a main peak in 500 to 10,000 molecular weight and a ratio (Mw/Mn) of the weight average molecular weight (Mw) to the number average molecular weight (Mn) within a range from 1.1 to 18.

2. The toner according to claim 1, wherein the sulfur-containing resin is a polymer containing a sulfonic acid group.

3. The toner according to claim 1, wherein the sulfur-containing resin is a copolymer of a monomer containing a sulfonic acid group and a vinyl monomer.

4. The toner according to claim 1, wherein the sulfur-containing resin is a copolymer of an aarylamidesulfonic acid type monomer and a vinyl monomer.

5. The toner according to claim 1, wherein the sulfur-containing resin is a copolymer of 2-acrylamido-2-methylpropanesulfonic acid and a vinyl monomer.

6. The toner according to claim 1, wherein the sulfur-containing resin is a negative charge control resin.

7. The toner according to claim 1, wherein the sulfur-containing resin is contained in 0.01 to 20 parts by weight based on 100 parts by weight of the binder resin.

8. The toner according to claim 1, wherein the sulfur-containing resin is contained in 0.5 to 3 parts by weight based on 100 parts by weight of the binder resin.

9. The toner according to claim 1, wherein the sulfur-containing resin is contained in 0.7 to 2 parts by weight based on 100 parts by weight of the binder resin.

10. The toner according to claim 1, wherein the sulfur-containing resin has a weight average molecular weight (Mw) of 17,000 to 100,000.

11. The toner according to claim 1, wherein the sulfur-containing resin has a weight average molecular weight (Mw) of 27,000 to 50,000.

12. The toner according to claim 1, wherein the sulfur-containing resin has a glass transition temperature (Tg) of 50 to 100° C.

13. The toner according to claim 1, wherein the sulfur-containing resin has a glass transition temperature (Tg) of 72 to 95° C.

14. The toner according to claim 1, wherein the toner has an acid value of 1 to 40 mg KOH/g.

15. The toner according to claim 1, wherein the toner has an acid value of 5 to 30 mg KOH/g.

16. The toner according to claim 1, wherein the toner has an acid value of 10 to 20 mg KOH/g.

17. The toner according to claim 1, wherein the binder resin contains a tetrahydrofuran (THF)-insoluble matter in an amount of 1 to 50% by weight based on the weight of the binder resin.

18. The toner according to claim 1, wherein the binder resin contains a tetrahydrofuran (THF)-insoluble matter in an amount of 5 to 40% by weight based on the weight of the binder resin.

19. The toner according to claim 1, wherein the binder resin contains a tetrahydrofuran (THF)-insoluble matter in an amount of 10 to 30% by weight based on the weight of the binder resin.

20. The toner according to claim 1, wherein the binder resin contains 50 to 95% by weight of the polyester unit.

21. The toner according to claim 1, wherein the binder resin contains 60 to 90% by weight of the polyester unit.

22. The toner according to claim 1, wherein the binder resin contains 65 to 85% by weight of the polyester unit.

23. The toner according to claim 1, wherein the binder resin of the toner has a THF-soluble batter having a peak in 2,000 to 15,000 molecular weight in the molecular weight distribution determined by gel permeation chromatography (GPC), a Z average molecular weight (Mz) of $2.0\times10^4$ or smaller and a ratio (Mz/Mw) of the Z average molecular weight (Mz) to the weight average molecular weight (Mw) within a range from 20 to 120.

24. The toner according to claim 1, wherein the binder resin of the toner has a THF-soluble matter having a peak in 4.000 to 12,000 molecular weight in the molecular weight distribution determined by gel permeation chromatography (GPC), a Z average molecular weight (Mz) of $1.5\times10^8$ or smaller and a ratio (Mz/Mw) of the Z average molecular weight (Mz) to the weight average molecular weight (Mw) within a range from 30 to 100.

25. The toner according to claim 1, wherein the binder resin of the toner has a THF-soluble matter having a peak in 6,000 to 10,000 molecular weight in the molecular weight distribution determined by gel permeation chromatography (GPC), a Z average molecular weight (Mz) of $1.0\times10^8$ or smaller and a ratio (Mz/Mw) of the Z average molecular weight (Mz) to the weight average molecular weight (Mw) within a range from 40 to 80.

26. The toner according to claim 1, wherein the toner contains a charge control agent composed mainly of an organoaluminum compound and/or an organoiron compound.

27. The toner according to claim 1, wherein the toner contains an organometal compound of a complex or a complex salt containing aluminum as a metal element and an aromatic hydroxycarboxylic acid, an aromatic diol, or an aromatic polycarboxylic acid as a ligand.

28. The toner according to claim 1, wherein the wax has a main peak in 700 to 5,000 molecular weight and a ratio (Mw/Mn) of the weight average molecular weight (Mw) to the number average molecular weight (Mn) within a range from 1.2 to 15.

29. The toner according to claim 1, wherein the wax is any of a hydrocarbon type wax, a polyethylene type wax and a polypropylene type wax.

30. The toner according to claim 1, wherein the wax contains a component having a structure represented by the formula (2):

$$CH_3—CH_2—(CH_2—CH_2)_X—CH_2—CH_2—A \quad (2)$$

wherein A represents hydroxyl or carboxyl; and X is an integer from 20 to 60.

31. The toner according to claim 1, wherein the wax is an acid-modified polyethylene wax having an acid value of 1 to 20 mg KOH/g.

32. The toner according to claim 1, wherein the wax is an acid-modified polypropylene wax having an acid value of 1 to 20 mg KOH/g.

33. The toner according to claim 1, wherein the toner has at least one endothermic peak within a temperature range of 70 to 150° C. In the measurement by a differential scanning calorimeter (DSC) at the time of increasing temperature.

34. The toner according to claim 1, wherein the toner has at least one endothermic peak within a temperature range of 75 to 130° C. In the measurement by a differential scanning calorimeter (DSC) at the time of increasing temperature.

35. The toner according to claim 1, wherein the toner has at least one endothermic peak within a temperature range of 80 to 110° C. In the measurement by a differential scanning calorimeter (DSC) at the time of increasing temperature.

36. The toner according to claim 1, wherein the toner has a weight average particle diameter of 4 to 12 $\mu$m and contains less than 30% by volume of particles with the particle diameter of 10.1 $\mu$m or larger in the particle diameter distribution of the toner.

37. The toner according to claim 1, wherein the toner has a weight average particle diameter of 5 to 9 $\mu$m and contains less than 20% by volume of particles with the particle diameter of 10.1 $\mu$m or larger in the particle diameter distribution of the toner.

38. The toner according to claim 1, wherein the toner has the weight average particle diameter of 5.5 to 8 $\mu$m and contains less than 10% by volume of particles with the particle diameter of 10.1 $\mu$m or larger in the particle diameter distribution of the toner.

39. The toner according to claim 1, wherein sulfur-containing resin is contained in 20 ppm to 5% by weight in terms of sulfur atom based on the weight of the toner.

40. The toner according to claim 1, wherein the sulfur-containing resin is contained in 50 ppm to 1% by weight in terms of sulfur atom based on the weight of the toner.

41. The toner according to claim 1, wherein the sulfur-containing resin is contained in 100 ppm to 0.5% by weight in terms of sulfur atom based on the weight of the toner.

42. An image forming method comprising:

(I) a developing step of forming a toner image by developing an electrostatic image held on an image bearing member by use of a toner;

(II) a transfer step of transferring the toner image formed on the image bearing member to a recording material through an intermediate transfer member or without the intermediate transfer member; and (III) a fixing step of fixing the toner image transferred to the recording material in the recording material with the application of heat;

wherein said toner comprises toner particles and an inorganic fine powder;

the toner particles comprise at least a binder resin, a colorant, a sulfur-containing resin, and a wax; and the binder resin contains a hybrid resin component comprising a vinyl type polymer unit and a polyester unit; the sulfur-containing resin is a resin selected from the group consisting of sulfur-containing polymers and sulfur-containing copolymers; the sulfur-containing resin has a weight average molecular weight (Mw) of 2,000 to 200,000; the sulfur-containing resin has a glass transition temperature (Tg) of 30 to 120° C.; and the wax has a main peak in 500 to 10,000 molecular weight and a ratio (Mw/Mn) of the weight average molecular weight (Mw) to the number average molecular weight (Mn) within a range from 1.1 to 18.

43. The method according to claim 42, wherein the image bearing member is electrically charged with a contact charging means to which a bias voltage is applied; the electrically charged image bearing member is exposed to form a digital latent image; the digital latent image is developed by a toner held in a development means to form a toner image; and the toner image is transferred to a transfer material through an intermediate transfer member or without the intermediate transfer member by a contact transferring means to which a bias voltage is applied.

44. The method according to claim 42, wherein the toner is a magnetic toner, and the development means comprises a developing sleeve including a magnetic field generating means and an elastic blade for forming a magnetic toner layer on the developing sleeve.

45. An image forming method comprising:

(I) a developing step of forming a toner image by developing an electrostatic image held on an image bearing member by use of a toner;

(II) a transfer step of transferring the toner image formed on the image bearing member to a recording material through an intermediate transfer member or without the intermediate transfer member; and (III) a fixing step of fixing the toner image transferred to the recording material in the recording material with the application of heat;

wherein the toner is a dry magnetic toner according to any one of claims 1–9, 10, 11, 12–27 and 28–41.

46. A process cartridge comprising at least an image bearing member for holding an electrostatic image and a development means for developing the electrostatic image formed on the image bearing member by use of a toner and both of which are supported as one unit, the process cartridge being detachably mountable to an image forming apparatus main body, wherein the toner comprises toner particles and an inorganic fine powder;

the toner particles comprising at least a binder resin, a colorant, a sulfur-containing resin, and a wax; and the binder resin containing a hybrid resin component comprising a vinyl type polymer unit and a polyester unit; the sulfur-containing resin being a resin selected from the group of sulfur-containing polymers and sulfur-containing copolymers; the sulfur-containing resin has a weight average molecular weight (Mw) of 2,000 to 200,000; the sulfur-containing resin has a glass transition temperature (Tg) of 30 to 120° C.; and the wax has a main peak in 500 to 10,000 molecular weight and a ratio (Mw/Mn) of the weight average molecular weight (Mw) to the number average molecular weight (Mn) within a range from 1.1 to 18.

47. The process-cartridge according to claim 46, wherein the image bearing member is a photosensitive drum.

48. The process-cartridge according to claim 46, wherein the process-cartridge further comprises a contact charging means.

49. A process cartridge comprising at least an image bearing member for holding an electrostatic image and a development means for developing the electrostatic image formed on the image bearing member by use of a toner and both of which are supported as one unit, the process cartridge being detachably mountable to an image forming apparatus main body, wherein the toner is one of toners according to any one of claims 1–9, 10, 11, 12–27 and 28–41.

* * * * *

UNITED STATES PATENT AND TRADEMARK OFFICE

CERTIFICATE OF CORRECTION

PATENT NO. : 6,593,052 B2
DATED : July 15, 2003
INVENTOR(S) : Junko Yoshikawa et al.

It is certified that error appears in the above-identified patent and that said Letters Patent is hereby corrected as shown below:

Title page,
Item [56], References Cited, FOREIGN PATENT DOCUMENTS, "2-623684" should read -- 9-2623684 --.

Column 1,
Line 10, "method. A" should read -- method, a --; and
Line 63, "toner" should read -- toner. --.

Column 2,
Line 26, "Component." should read -- component. --;
Line 38, "of" (2nd occurrence) shoud read -- in --; and
Line 58, "an-aspect" should read -- an aspect --.

Column 3,
Line 66, "2.000" should read -- 2,000 --.

Column 5,
Line 17, "If" should read -- if --; and
Line 46, "aromative" is -- aromatic --.

Column 6,
Line 8, "monomer" should read -- monomer. --;
Line 10, "fumalic" should read -- fumaric --; and
Line 61, "If" should read -- if --.

Column 7,
Line 3, "solvent. Usable" should read -- solvent, usable -- and "mixture. It" should read -- mixture, it --;
Line 11, "tert-butylcumryl" should read -- tert-butylcumyl --;
Line 14, "mathoxy" should read -- methoxy --; and
Line 40, "owing to that" should read -- since --.

Column 8,
Line 57, "10,000" should read -- 5,000 --.

Column 11,
Line 4, "as" should be deleted; and
Line 17, "β-methylene" should read -- α-methylene --.

UNITED STATES PATENT AND TRADEMARK OFFICE

CERTIFICATE OF CORRECTION

PATENT NO. : 6,593,052 B2
DATED : July 15, 2003
INVENTOR(S) : Junko Yoshikawa et al.

It is certified that error appears in the above-identified patent and that said Letters Patent is hereby corrected as shown below:

Column 12,
Line 1, “at” should be deleted; and
Line 37, “tetraethylol” should read -- tetramethylol --.

Column 13,
Line 3, “dimethylvaleronitrile).” should read -- dimethylvaleronitrile), --; and
Line 26, ethylhexamoate-di” should read -- ethlylhexanoate, di --.

Column 14,
Line 62, “to contain” should read -- contains --; and
Line 67, “material” should read -- materials --.

Column 16,
Line 67, “D-C Pine” should read -- D-C Fine --.

Column 17,
Line 11, “allyldimethylchlorosiltne,” should read -- allyldimethylchlorosilane, --;
Line 14, “chloroethyltrichlorosilane,” should read -- β-chloroethyltrichlorosilane,” --;
Line 15, “β-chloromethyldirethylchlorosilane,” should read -- chloromethyldimethylchlorosilane, --;
Line 17, “nosllyl” should read -- nosilyl --; and
Line 20, “divinyltetramethylaisiloxane,” should read -- divinyltetramethyldisiloxane, --.

Column 18,
Line 13, “fluorides” should read -- fluoride, --.

Column 21,
Line 17, “is” should be deleted;
Line 32, “preferable” should read -- preferably --; and
Line 51, “photocuable” should read -- photocurable --.

Column 22,
Line 24, “shapelss” should read -- shapeless --.

Column 23,
Line 24, “The fixing” should read -- ¶The fixing --;
Line 33, “Composed” should read -- composed --;
Line 48, “514” should read -- 514. --; and
Line 56, “PAP” should read -- PAF --.

UNITED STATES PATENT AND TRADEMARK OFFICE

CERTIFICATE OF CORRECTION

PATENT NO. : 6,593,052 B2
DATED : July 15, 2003
INVENTOR(S) : Junko Yoshikawa et al.

It is certified that error appears in the above-identified patent and that said Letters Patent is hereby corrected as shown below:

Column 24,
Line 59, “measurement” should read -- measurement. --.

Column 25,
Line 2, “employed” should read -- employed. --; and
Line 9, “G500H” should read -- G5000H --.

Column 26,
Line 7, “out” should read -- out. --; and
Line 24, “lonol” should read -- ionol --.

Column 28,
Line 9, “Ion” should read -- ion --; and
Line 56, “2.21” should read -- 2.2’ --.

Column 31,
Line 16, “in” should read -- in --; and
Line 27, “XOM/g,” should read -- KOH/g, --.

Column 32,
Line 43, “In” should read -- in --.

Column 33,
Line 7, “(E-12)” should read -- (H-12) --.

Column 34,
Line 7, “The reflectance” should read -- ¶ The reflectance --.

Column 40,
Ex. 16, Mx/Mw, “62” should read -- 82 --.

Column 43,
Line 15, “batter” should read -- matter --;
Line 18, “$2.0 \times 10^{4}$” should read -- $2.0 \times 10^{8}$ --; and
Line 60, “X” should read -- x --.

UNITED STATES PATENT AND TRADEMARK OFFICE

CERTIFICATE OF CORRECTION

PATENT NO. : 6,593,052 B2
DATED : July 15, 2003
INVENTOR(S) : Junko Yoshikawa et al.

It is certified that error appears in the above-identified patent and that said Letters Patent is hereby corrected as shown below:

Column 45,
Line 26, "claims 1-9, 10, 11, 12-27 and 28-41" should read -- claims 1-41. --.

Column 46,
Line 31, "claims 1-9, 10, 11, 12-27 and 28-41" should read -- claims 1-41. --.

Signed and Sealed this

Thirty-first Day of August, 2004

JON W. DUDAS
*Director of the United States Patent and Trademark Office*